US005593333A

United States Patent [19]

Johnson

[11] Patent Number: 5,593,333

[45] Date of Patent: Jan. 14, 1997

[54] FIN ASSEMBLY FOR FLOAT TUBE USERS

[76] Inventor: Carroll L. Johnson, 2658 Paradise Way, Grand Junction, Colo. 81506

[21] Appl. No.: 550,021

[22] Filed: Oct. 30, 1995

[51] Int. Cl.[6] ..... A63B 31/11

[52] U.S. Cl. ..... 441/62; 441/63

[58] Field of Search ..... 441/55, 61–64, 441/130–132, 77; 482/111

[56] References Cited

U.S. PATENT DOCUMENTS

| | | | |
|---|---|---|---|
| 1,007,867 | 11/1911 | Halvorsen | 441/62 |
| 1,326,471 | 12/1919 | Becherer | 441/63 |
| 2,094,532 | 9/1937 | Glad | 441/62 |
| 2,343,965 | 3/1944 | Fisch | 441/61 |
| 4,664,639 | 5/1987 | Schneider | 441/61 |
| 5,338,275 | 8/1994 | Chek | 441/61 |

*Primary Examiner*—Sherman Basinger
*Attorney, Agent, or Firm*—John L. Isaac

[57] ABSTRACT

A fin assembly is disclosed for attachment to a boot of a float tube user, the boot having a sole, a toe and a heel. The assembly includes a base member having a mechanism for attachment to a boot. The base member has a front portion for attachment proximate the toe of the boot and a rear portion for attachment proximate the heel of the boot. A fin member is provided with front and rear ends. A mechanism is provided for pivotally mounting the front end of the fin member to the front portion of the base member. The fin member is pivotally moveable between a first operational position wherein the fin member rear end projects below the base member to provide substantial resistance to flow of water as the fin member is moved in a rearward direction relative to the user for propelling the user forwardly in the water, and a second operational position wherein the fin member rear end is aligned proximate the base member rear portion to provide substantially reduced resistance to flow of water as the fin member is moved in a forward direction relative to the user. Finally, a mechanism is provided for limiting the maximum angle between the fin member in its first operational position and the plane of the base member.

29 Claims, 7 Drawing Sheets

FIN ASSEMBLY FOR FLOAT TUBE USERS

RELATED APPLICATIONS

This application is related to U.S. patent application Ser. No. 08/200,751 which was filed on Feb. 23, 1994, and now U.S. Pat. No. 5,531,621 and U.S. patent application Ser. No. 08/553,770, which was filed on Oct. 23, 1995, both of which applications are now pending. The contents of these two patent applications are specifically incorporated by reference.

BACKGROUND OF THE INVENTION

1. Field of the Invention

This invention relates generally to an improved propulsion mechanism for use with float tubes commonly used in fishing and, more particularly, to an improved foot fin assembly for propelling the user of such a float tube. Specifically, the present invention relates to an improved foot fin assembly for use in propelling the user of a float tube in a forwardly facing direction while simultaneously permitting the user of such foot fins to walk in shallow water without removing the fin assembly.

2. Description of the Prior Art

In general, users of float tubes for fishing incorporate some type of propulsion devices on their feet in order to assist in moving about the water's surface. Most float tube fins are similar in design to the foot fins used by swimmers and divers. Illustrations of such devices include those shown in U.S. Pat. Nos. 1,745,280, 2,898,611, 3,183,529, 3,268,927, 4,857,024, 4,889,510, 4,929,206, 4,940,437 and 5,108,327 as well as German Patent No. 4020235. Such devices operate by movement of the user's legs and feet in a flutter kick which propels the swimmer or diver in a forward direction. However, when they are utilized by the user of a float tube, they propel the float tube user rearwardly or backwardly relative to the direction the user is facing. This direction is generally opposite the direction the float tube user normally wishes to move when pursuing rising fish or in moving to another spot located in front of him. Moreover, the efficiency of such prior art fins is low so that the use of such devices in traveling any type of a distance when using a float tube is generally very strenuous and tiring.

In addition, these types of fins generally limit normal walking foot movement due to their forward extension portions which create a risk of falling while walking with the fins on. Walking in marginal water to enter or exit a body of water is particularly hazardous, for in addition to the clumsiness of the protruding fins and the restriction of movement and visibility caused by the float tubes, the walker has to overcome the water's resistance on the fins with each step. As a consequence, most users of forward extending fins walk backwards to enter include those shown in U.S. Pat. Nos. 1,745,280, 2,898,611, 3,183,529, 3,268,927, 4,857,024, 4,889,510, 4,929,206, 4,940,437 and 5,108,327 as well as German Patent No. 4020235. Such devices operate by movement of the user's legs and feet in a flutter kick which propels the swimmer or diver in a forward direction. However, shape of an annular float tube limits movement, necessitating that the fins be attached to the user's feet prior to donning the float tube. In such an instance, with the float tube lying flat on the ground and the fins attached to the user's feet, the user then balances on one foot while stepping over the circumference of the tube with the other foot and inserting the other foot that the use of such devices in traveling any type of a distance when using a float tube is generally very strenuous and tiring.

In addition, these types of fins generally limit normal walking foot movement due to their forward extension portions which create a risk of falling while walking with the fins on. their general configuration and size, and the constriction of the seat of an annular float tube makes it extremely awkward to insert both feet with fins in place into the leg opening of a float tube. Balancing is especially difficult while bending over to maneuver the unwieldy tube into position to facilitate inserting the fin of the second foot into the leg opening.

As the result of such difficulties, several fins have been designed to provide means of forward propulsion by float tube users. Moreover, designs have been provided wherein a single paddle is secured to an existing shoe of a float tube user. Such designs include U.S. Pat. Nos. 1,983,609, 2,395,844 and 4,664,639. Moreover, an unpatented device known as the Paddle Pusher by Fishmaster Manufacturing Co. of Oklahoma City, Okla., provides side paddles to be worn on existing tennis shoes. The design of these type of fins compel the float tube user to assume a forced, unnatural position in the float tube during use. Moreover, these designs are generally inefficient in use relative to a full leg movement of the user of a float tube. For example, the design and construction of a float tube seat typically places a user thereof in the posture of a person seated in a chair with his or her legs and feet extended generally outwardly and forwardly. Use of the fin disclosed in U.S. Pat. No. 4,664,639 requires the user to lean forward against the designed posture of the float tube in order to position his or her legs in a vertical plane to provide sufficient leverage to make use of the device of this particular patent. This is due to the fact that the fin is integrally secured as part of the sole of the shoe or as part of a sleeve that fits over the shoe. In either instance, substantial rearward force from the leg and foot of the float tube user is necessary to move the fin away from the sole of the shoe and into position to create forward user motion. Moreover, this integral flap is by its nature urged toward its closed position against the boot sole. The paddle pusher device also compels the user of a float tube to assume a forced, upright position to move through the water. As a consequence, much of the user's leg motion with these known as the Paddle Pusher by Fishmaster Manufacturing Co. of Oklahoma City, Okla., provides side paddles to be worn on existing tennis shoes. The design of these type of fins compel the float tube user to assume a forced, unnatural position in the float tube during use. Moreover, these designs are generally inefficient in use relative to a full leg movement of the 805,525 requires specific movement of the user to open and close the flaps. The device illustrated in U.S. Pat. No. 3,081,467 is adapted to be oriented in a vertically downward position from the toe of a swim flipper for operation and in a vertically upward position in order to permit walking by a swimmer. However, given the nature of a swim flipper, forward walking is very difficult as previously mentioned. Moreover, this device is designed to slip over the foot similar to a swim flipper and designed to help push water away from the foot as the user's leg is extended outwardly thereby pushing the user of a float tube rearwardly as with many prior art devices.

The devices of the above related applications Ser. No. 08/200,751, filed Feb. 23, 1994, now U.S. Pat. No. 5,531,621 and Ser. No. 08/553,770 filed Oct. 23, 1995, the contents of which have been specifically incorporated herein by reference, overcome many of the objections to the prior art devices described above. However, the hinging arrangement of these related inventions can sometimes be a little awkward when moving any one of them from its closed to its operative position. The present invention, however, overcomes all of the aforementioned difficulties of the prior art devices and also improves the ease by which a user of the device can move the device in its reset position for minimum water resistance to its 805,525 requires specific movement of the user to open and close the flaps. The device illustrated in U.S. Pat. No. 3,081,467 is adapted to be oriented in a vertically downward position from the toe of a swim flipper for operation and in a vertically upward position in order to permit walking by a swimmer. However, given the nature of a swim flipper, forward walking is very It is another object of the present invention to provide a fin assembly which is designed to permit the user to walk in shallow water without removal of the fin assembly from the feet of the user.

Yet another object of the present invention is to provide a fin assembly for use by a user of a float tube which is more efficient and utilizes less energy for movement due to reduced drag on the reset stroke.

A further object of the present invention is to provide a fin assembly for attachment to the boot of a float tuber user which is designed for greater ease of operation and movement between its operational position and its reset position.

Still another object of the present invention is to provide a fin assembly which is of simpler construction and greater adaptability for fastening to a wide variety of foot gear.

To achieve the foregoing and other objects and in accordance with the purpose of the present invention, as embodied and broadly described herein, a fin assembly is disclosed for attachment to a boot of a float tube user, the boot having a sole, a toe and a heel. The assembly includes a base member having a mechanism for attachment to a boot. The base member has a front portion for attachment proximate the toe of the boot and a rear portion for attachment proximate the heel of the boot. A fin member is provided with front and rear ends. A mechanism is provided for pivotally mounting the front end of the fin member to the front portion of the base member. The fin member is pivotally moveable between a first operational position wherein the fin member rear end projects below the base member to provide substantial resistance to flow of water as the fin member is moved in a rearward direction relative to the user for propelling the user forwardly in the water, and a second operational position wherein the fin member rear end is aligned proximate the base member rear portion to provide substantially reduced resistance to flow of water as the tin member is moved in a forward direction relative to the user. Finally, a mechanism is provided for limiting the maximum angle between the fin member in its first operational position and the plane of the base member.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Figure 2:
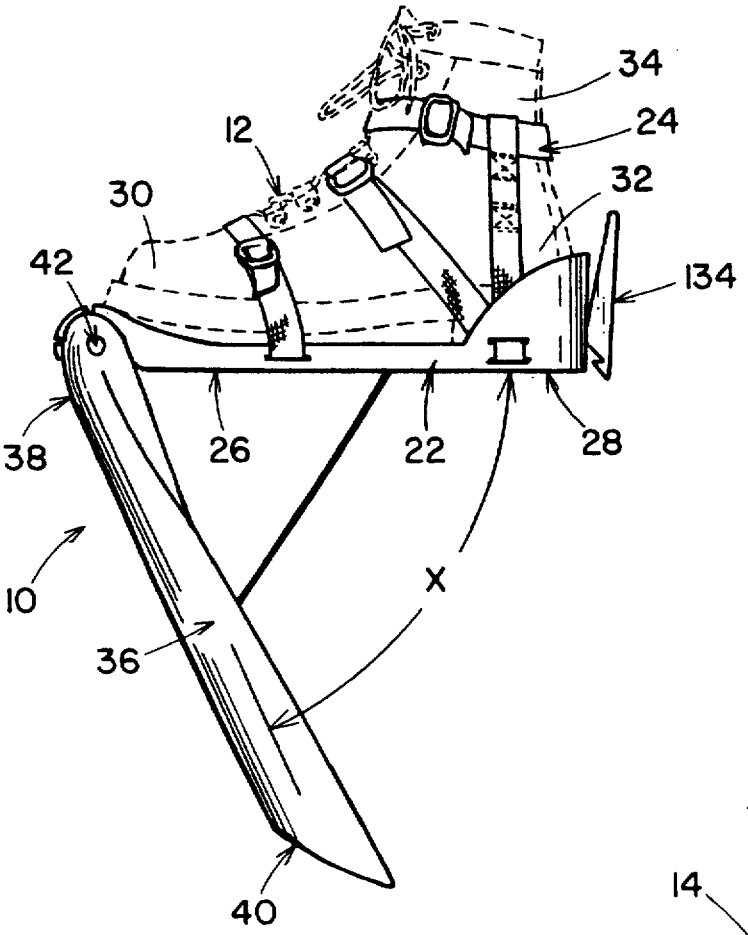
FIG. 2 is a side view of the fin assembly of the present invention secured to the boot of a user and in an open operational position.
Figure 1:
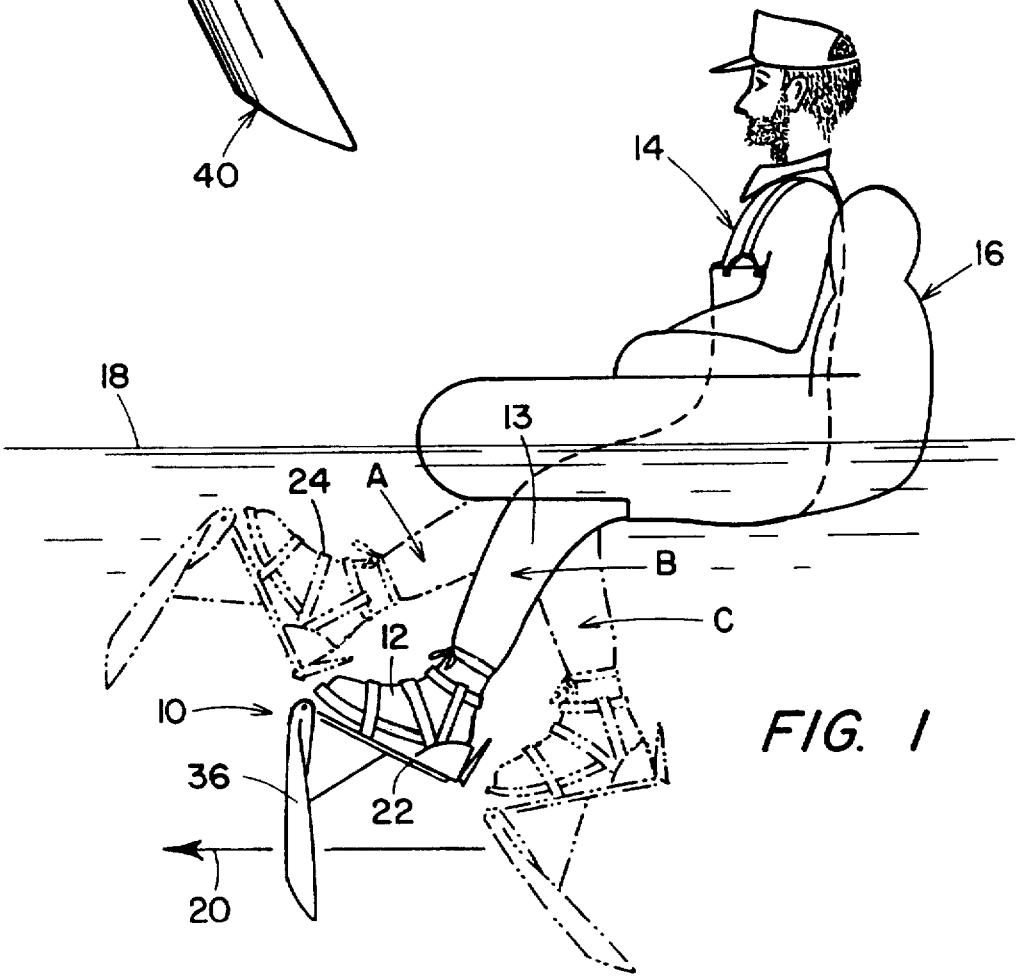
FIG. 1 is a side perspective view illustrating a fin assembly constructed in accordance with the present invention in position on the foot of a user while in a float tube and in an operational position.

Referring first to FIGS. 1 and 2, a fin assembly 10 is illustrated in its extended operational position. The fin assembly 10 is secured to a boot 12 of a user 14 positioned within a typical float tube 16. The fin assembly 10 is designed to propel the user 14 and the float tube 16 forwardly across a water surface 18 in the direction illustrated by the arrow 20 by movement of the legs 13 of the user 14. In this manner, the user 14 is moved in the direction which he faces thus enhancing safety as well as providing a significant advantage to the user 14 when fishing or the like.

The principal components of the fin assembly 10 of the present invention are constructed primarily of molded semi-rigid plastic material, although other strong, lightweight and corrosion resistant materials such as aluminum can be utilized integral with plastic materials, or as a substitute for the plastic material in some parts of the fin assembly 10. In addition, it should be understood that in the drawings, only one fin assembly or a sub-assembly of one fin assembly is described in detail, and it should be understood that there are paired left and right fins and subassemblies which are constructed and operate in substantially identical fashion.

The fin assembly 10 of the present invention includes a base member 22 which is secured to the boot 12 of a user 14 by an attachment mechanism 24. The base member 22 operational position. The fin assembly 10 is secured to a boot 12 of a user 14 positioned within a typical float tube 16. The fin assembly 10 is designed to propel the user 14 and the float tube 16 forwardly across a water surface 18 in the direction illustrated by the arrow 20 by movement of the legs 13 of the user 14. In this manner, the user 14 is moved in the direction 38 of the fin member 36 is secured to the front portion 26 of the base member 22 by a hinge mechanism 42 as described in greater detail below.

Referring now to in more detail to FIGS. 1–5, the fin member 36 includes a pair of side edges 44, 46 which diverge outwardly from each other from the front portion 38 toward the rear portion 40. In this manner, the width dimension of the rear portion 40 is substantially greater than the width dimension of the front portion 38. This shape is typical of swim fins or flippers. The outer surface 50 of the fin member 36 is preferably slightly curved upwardly toward the base member 22 in a scooped fashion so as to create greater water resistance when the fin assembly 10 is moved in a rearwardly direction, the power stroke, as indicated by the arrow 52. A pair of ridge supports 54, 56 extended rearwardly from the front portion 38 toward the rear portion 40 to provide strength and rigidity to the fin member 36. The ridge supports 54, 56 terminate at the forward portion 38 of the fin member 36 in rounded ends 58, 60. The rounded end portions 58, 60 of the ridges 54, 56 serve as pivot members for the hinge mechanism 42 as described in greater detail below. A restraining strap 62 preferably is secured to the inner surface 64 of the fin member 36 and the bottom surface 66 of the base member 22. The restraining strap 62 is preferably woven nylon, although any suitably strong yet flexible material may be utilized. The restraining strap 62 may be secured to the surfaces 64, 66 by riveting, sewing or any other suitable manner of attachment. The restraining strap 62 functions to assist in transferring the force generated in the power stroke from the foot 12 and leg 13 of user 14 to the fin member 36. It also assists the stop members (discussed in rear portion 40. In this manner, the width dimension of the rear portion 40 is substantially greater than the width dimension of the front portion 38. This shape is typical of swim fins or flippers. The outer surface 50 of the fin member 36 is preferably slightly curved upwardly toward the base member 22 in a scooped fashion so as to create greater water resistance when which, in preferred form, depend downwardly from the bottom surface 66 as well as extend upwardly above the upper surface 74 of the base plate 68. In preferred form, the side edges 70, 72 terminate at the rear portion 28 of the base member 22 in a heel cup 76 that is sized and shaped to snugly receive the heel portion 32 of the heel 12. In this manner, the shoe or boot 12 may be snugly held against the base member 22 by the attachment mechanism 24 as further described in greater detail below.

Figure 4:
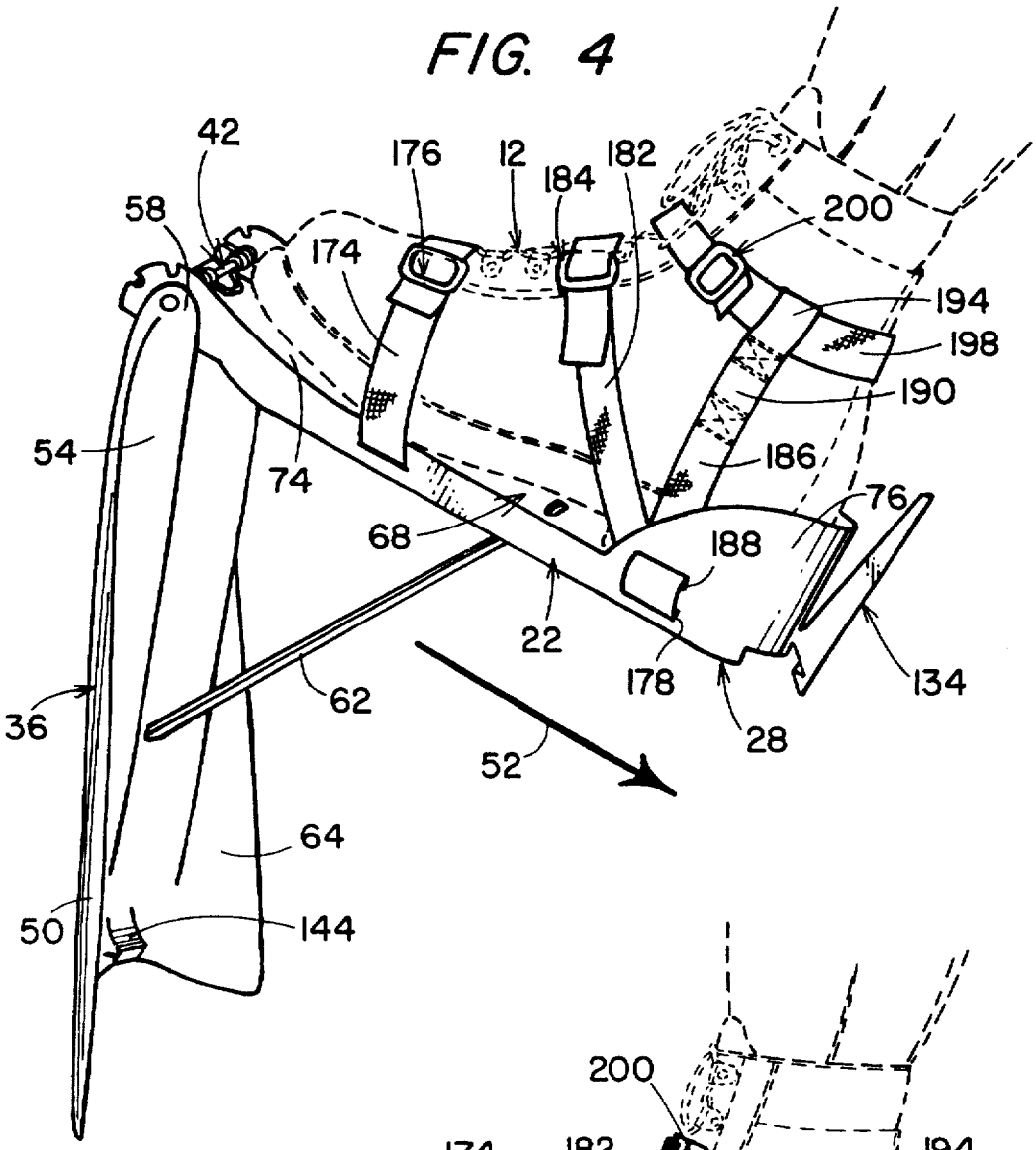
FIG. 4 is a side perspective view of the fin assembly of the present invention attached to the boot of a user and illustrating the fin assembly in its open operational position.

When the fin assembly 10 is in its fully first operational position as illustrated in FIGS. 1, 2 and 4, the fin member 36 pivots relative to the base member 22 at the hinge mechanism 42 and extends below the base member 22 at an angle "X". In preferred form, the angle "X" is less than 90° and is preferably an acute angle ranging between 60°–75°. The actual preferred angle "X" within this range may vary depending upon the flexibility of the material selected for construction of the fin member 36. If the angle is substantially less than about 60°, then the power efficiency of the fin assembly 10 is substantially reduced. However, if the angle substantially exceeds 75°, then the fin assembly 10 tends to lift the front of the tube 16 rather than propel it forwardly.

Figure 3:
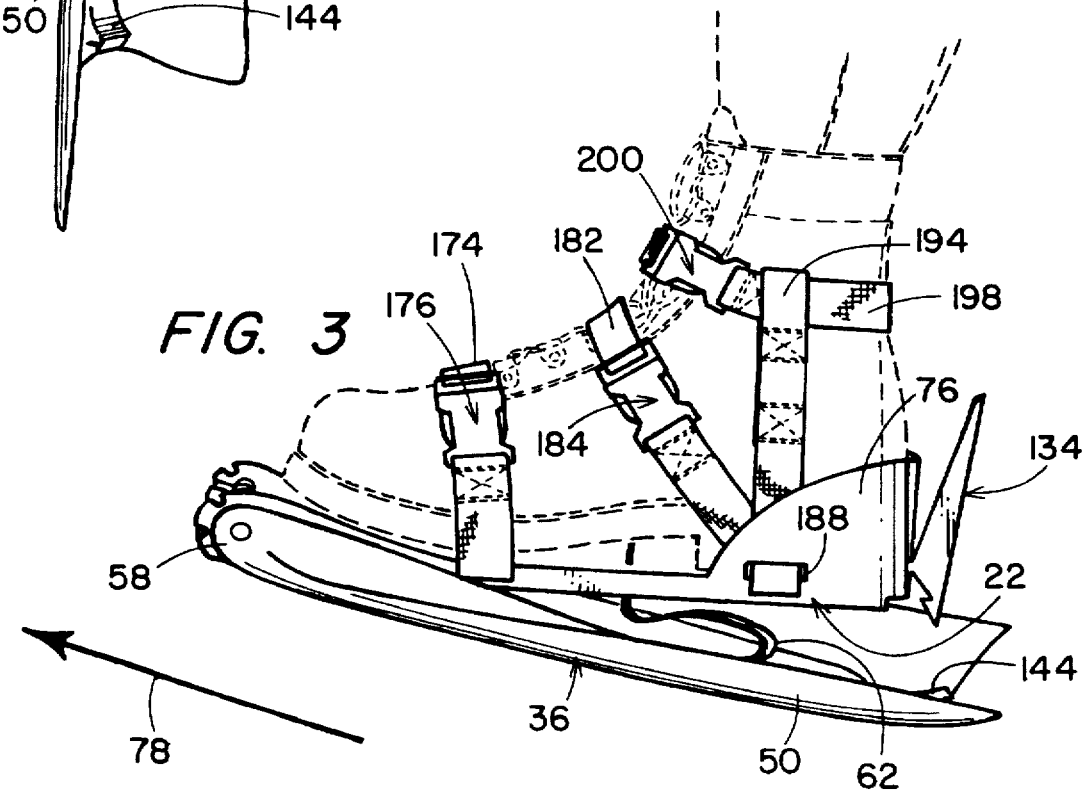
FIG. 3 is a side view of the fin assembly of the present invention mounted to the boot of a user and illustrating the fin assembly in its second operational or reset position.

As the user 14 moves his or her leg 13 from position A to position B to position C as illustrated in FIG. 1, thereby moving the fin member 36 and fin assembly 10 in the direction indicated by the arrow 52 of FIG. 4, the inner surface 64 of the fin member 36 creates substantial resistance to the flow of water and thus propels the user 14 forwardly in the direction 20 of FIG. 1. Once this power or operational stroke of the user 14 is completed, the user 14 then moves his or her leg 13 from position C back to position A. When this movement occurs, water pressure against the outer surface 50 of the fin member 36 feathers the fin member 36 and moves it to its reset position as indicated in FIG. 3. Thus, as the fin member 36 and fin assembly 10 is moved back toward its starting position A in the direction indicated and extends below the base member 22 at an angle "X". In preferred form, the angle "X" is less than 90° and is preferably an acute angle ranging between 60°–75°. The actual preferred angle "X" within this range may vary depending upon the flexibility of the material selected for construction of the fin member 36. If the angle is substantially less than about 60°, then the moving the fin assembly 10 in the direction 52 and resting leg muscles when moving the legs 13 back from position C to A in direction 78. Due to the construction of the present invention and the hinging mechanism as described below along with the angle limitations imposed on angle "X", the user 14 may move his or her legs 13 between positions A and C to propel himself or herself forward without having to lean forward in the float tube 16 or in any other way having to adjust his or her posture other than sitting back in a fashion typical of sitting in a chair. This provides maximum balance and safety with a minimum of effort of the user 14.

Referring now with particularity to FIGS. 5–9, the side edges 70 and 72 of the base member 22 each terminate at their front portion in curved end portions 80 and 82, respectively. The hinge mechanism 42 which interconnects the fin member 36 with the base member 22 preferably includes a hinge pin 84 which passes through apertures 86, 88 in the ends 58, 60 of the ridge supports 54, 56 and apertures 90, 92 which extend through the end portions 80, 82 of the side edges 70, 72. Preferably, a washer 94 is positioned between the end 58 and the end portion 80, while a washer 96 is positioned between the rounded end 60 and the end portion 82. The hinge pin 84 may be in the form of a bolt, rivet, or any other known pin member and firmly secures the rounded ends 58, 60 to the end portions 80, 82.

In the preferred embodiment of the present invention, a spring mechanism 98 is provided to create a bias force against the fin member 36 to urge it to its fully operational position as illustrated in FIGS. 1, 2 and 4. The purpose of this bias force is so that the fin member 36 might be moved to its fully operational position as soon as a user 14 has completed the reset stroke and moved the boot 12 and leg 13 into the position A. Otherwise, a portion of the power stroke wherein the user 14 moves the leg 13 from position A toward position C would be required to push the fin member 36 outwardly from the base member 22 until its full operational position has been established. Such a procedure wastes a portion of the power stroke and energy of the user 14. The spring mechanism 98 obviates this loss of a portion of the power stroke by urging the fin member 36 to its fully extended and operational position once the user 14 has ceased forward movement of his or her leg 13 during the reset stroke.

In preferred form, the spring mechanism 98 may be of any selected type of spring bias device but preferably includes a unitary spring member 100 having a pair of helical spiral portions 102 and 104 that are spaced by a straight portion forming a bight 106. Each helical spiral portion 102, 104 terminates in an L-shaped extension 108, 110, respectively, which respectively include end members 112, 114. The forwardmost portion 26 of the base member 22 includes an aperture 116 in the base plate 68. The aperture 116 is centered between the end portions 80, 82 beneath the hinge pin 84. The spring member 100 is sized and shaped so that the hinge pin 84 passes through the helical spiral portions 102, 104, and that the bight 106 is spaced immediately above the aperture 116 and is sized to pass therethrough. The end portions 80, 82 each include a first pair of notches 118, 120, respectively, and a second pair of notches 122, 124, respectively. The notches 118, 120 and 122, 124 are sized and shaped to receive the end members 112, 114 of the L-shaped extensions 108, 110 of the spring member 100. Once the end portions 112, 114 are positioned within the notches 118, 120, respectively, the bight member 106 presses down against the upper surface 64 of the fin member 36 through the aperture 116. In preferred form a raised surface 126 is created on the upper surface 64 at the forward portion 38 of the fin member 36. Thus, the spring tension created by the helical spiral portions 102, 104 creates a bias force against the surface 126 by the bight member 106 when the end portions 112, 114 are engaged within the notches 118, 120. If it is desired to increase the bias force of the spring member 100 against the fin member 36, then the end portions 112, 114 may be moved to the paired notches 122, 124, respectively. This creates a greater tension in the spiral portions 102, 104 creating a greater bias force of the bight 106 against the surface 126. This bias force tends to urge the fin member 36 away from the base member 22 when there is no water pressure against the outer surface 50 of the fin member 36. Therefore, once the user 14 has moved the fin assembly 10 into its position A at the beginning of its power stroke, the spring member 100 will force the fin member 36 away from the base member 22 to the full extent allowed by the fin assembly 10.

Figure 8:
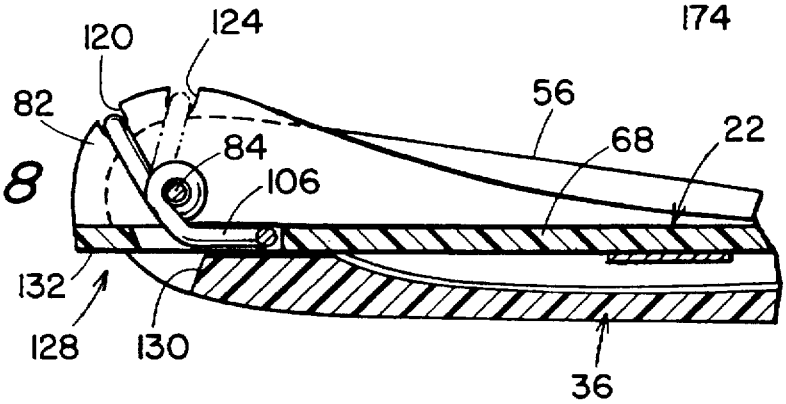
FIG. 8 is a cross-sectional view taken substantially along line 8—8 of FIG. 7.

A stop mechanism 128 is preferably utilized to limit the angle "X" integrated between the fin member 36 and the base member 22 when the fin member 36 is in its fully operational position created by the bias force of the spring member 100. In preferred form, the stop member 128 includes a shoulder 130 that is positioned at the forwardmost end of the fin member 36 and a stop ledge 132 that is positioned along the forward bottom surface of the base portion 22. The placement of the shoulder 130 in terms of how far forwardly it extends at the front of the fin member 36 as well as the angle of the surface 130 relative to the stop surface 132 will determine the maximum angle "X". Clearly, the closer the surfaces 130, 132 when the fin member 36 is in its fully retracted position as illustrated in FIG. 8, the smaller the angle "X". Moreover, the greater the surfaces 130, 132 are spaced from each other in the reset position, the greater the angle "X". It should also be noted that the stop mechanism 128 and the retaining strap 62 are the two members that transfer the force from the leg 13 of the user 14 to the fin member 36 through the base member 22. In preferred form, the length of the restraining strap 62 is designed to be at its fully extended, taut position when the shoulder 130 and the stop surface 132 are in an abutting relationship, thereby enabling the retention from the base member 22 to the full extent allowed by the fin assembly 10.

A stop mechanism 128 is preferably utilized to limit the angle "X" integrated between the fin member 36 and the base member 22 when the fin member 36 is in its fully operational position created by the bias force of the spring member 100. In preferred form, the stop member 128 includes a shoulder 130 that is positioned at the forwardmost end of the fin member 36 and a stop ledge 132 that is positioned along the forward bottom surface of the base portion 22. The placement of the shoulder 130 in terms of how far forwardly it extends at the front of the fin member 36 as well as the angle of the surface 130 relative to the stop selectively secured to the base member 22 wherein the fin member 36 is not free to move to its open operational position. This latching of the fin member 36 to the base member 22 enables the user 14 to readily put the fin assembly 10 onto the boot 12 and allows the user 14 to enter the float tube 16 without the fin member 36 flopping around in its open position. Moreover, this latching of the fin member 36 to the base member 22 also permits the user 14 to walk on the bottom surface 50 of the fin member 36 on dry land or in shallow water. To accomplish this latching, a latch mechanism 134 is preferably utilized. In preferred form, the latching mechanism 134 includes a latch arm 136 having a pawl 138 at its connection end and a lever arm 140 at its free end. The latch arm 136 is hinged at its center portion 142 to allow the lever arm 140 to engage or disengage the pawl 138. In preferred form, a catch member 144 is disposed on the inner surface 64 toward the rear portion 40 of the fin member 36 and includes a tooth or hook end 146 that is sized and shaped for engagement with the pawl 138. A spiral spring 148 is positioned between the inner surface 150 of the lever arm 140 and the outer surface 152 of the heel cup 76. The spring member 148 is positioned so as to create an outward bias force against the lever arm 140 above the hinge member 142 so as to continuously urge the pawl 138 into engagement with the catch hook 146. By pressing the lever arm 140 toward the ankle 34 of the user 14, the bias of the spring member 148 is overcome, and the pawl 138 disengages from the hook 146. Once the pressure against the lever arm 140 is released, the spring member 148 immediately urges the lever arm 140 outwardly from the heel cup 76 which pivots the pawl 138 toward the base member 22. this latching of the fin member 36 to the base member 22 also permits the user 14 to walk on the bottom surface 50 of the fin member 36 on dry land or in shallow water. To accomplish this latching, a latch mechanism 134 is preferably utilized. In preferred form, the latching mechanism 134 includes a latch arm 136 having a pawl 138 at its connection end and a lever 76 until the stop 160 engages the heel cup 76 or the pawl 138 engages the hook 146. Once a force is created against the lever arm 140 which overcomes the bias force of the spring 148 in a direction toward the heel cup 76, the pawl 138 will be rotated away from the heel cup 76 so as to disengage from the catch hook 146 thereby allowing the fin member 36 to immediately move toward its operational position due to the bias of the spring member 100. In an alternate form of the invention illustrated in FIG. 13, the hinge mechanism 142 is in the form of a living hinge wherein the latch arm 136 is connected directly to the heel cup 76 by an integral connecting arm 162 having a reduced center portion 164 that acts as the hinge portion. Thus, as pressure against the lever arm 140 overcomes the bias of the spring 148, the pawl 138 is moved away from the heel cup 76 by flexing the connecting arm 162 thereby releasing the fin member 36. Likewise, the bias of the spring member 148 against the lever arm 140 pivots the latch arm 136 about the connecting arm 162 to engage the pawl 138 with the catch hook 146 similar to the prior embodiment.

Figure 5:
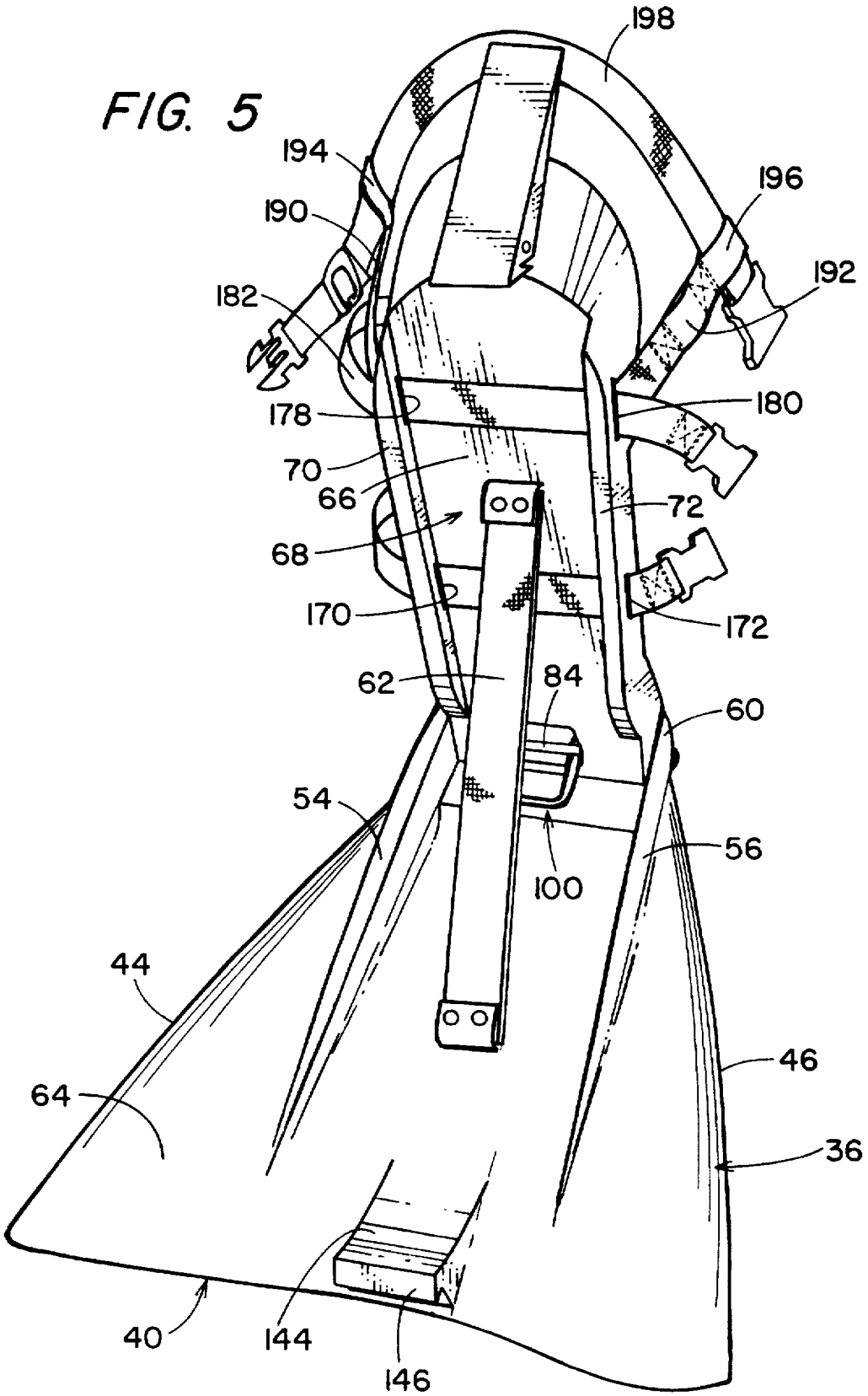
FIG. 5 is a rear perspective view of the fin assembly of the present invention in its open operational position.

As previously indicated, the base member 22 is secured to the boot 12 of the user 14 by an attachment mechanism 24. In one embodiment of the present invention as clearly illustrated in FIGS. 1–5, a pair of slots 170, 172 are disposed in the side edges 70, 72 toward the forward portion 26 of the base member 22. The slots 170, 172 are preferably aligned below the base plate 68. A first strap 174 passes through the slots 170, 172 and has its ends interconnected at a connecting member 176. The connecting member 176 may be in the form of a buckle as illustrated in FIGS. 2 and 4, or in the form of a plastic latching mechanism as indicated in FIGS. 3 and 5 and as commonly found in most sporting goods stores. In either event, the strap 174 is adjustable at the connecting member 176 so as to firmly hold the toe 30 against the base plate 68. In similar manner, a pair of slots 178, 180 are positioned in the side edges 70, 72 at the rear portion 28 of the base member 22 and aligned below the base plate 68. A second strap 182 passes through the slots 178, 180 beneath the bottom surface 66 of the base plate 68 and interconnects at its ends by a connecting member 184 similar to the connecting member 176. The connecting member 184 may likewise be a buckle or other latching mechanism as previously described. A third strap 186 is also provided and it passes through the slots 178, 180. Preferably, additional slots 188, 189 are spaced immediately above each of the slots 178, 180, respectively, in the heel cup 76 above the plate 68. The third strap 186 passes back through the slots 188, 189 so as to move upward along the boot 12 toward the ankle portion 34. The strap 186 preferably includes a first pair of connection openings 190, 192 and a second set of connection openings 194, 196 that are at the terminal ends thereof. An ankle strap 198 surrounds the ankle portion 34 of the boot 12 and passes through the first set of openings 190, 192 or the second set of openings 194, 196. The ends of the ankle strap are adjustably interconnected by a connection member 200 which is similar to the connection members 176 and 184. FIGS. 1–5 illustrate the strap 198 passing through the upper connection openings 194, 196 of the strap 186. However, the ankle strap 198 may also pass through the first set of connection openings 190, 192 as more clearly illustrated in FIG. 10. Whether the ankle strap 198 passes through the first set of connection openings 190, 192 or the second set of connection openings 194, 196 depends upon the size and type of boot 12 that is utilized by the user 14.

Figure 10:
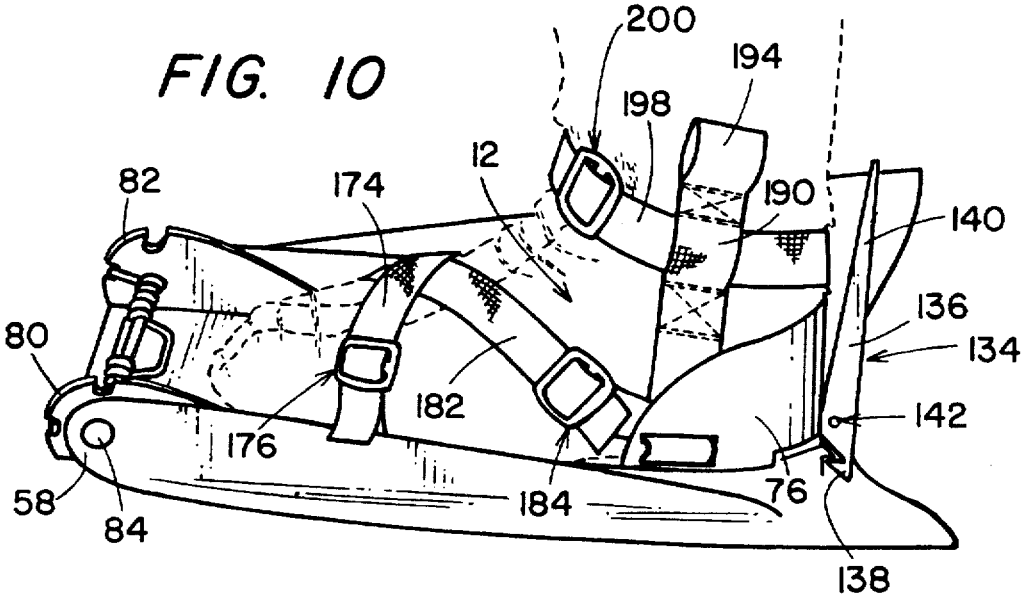
FIG. 10 is a side perspective view of the fin assembly of the present invention secured to the foot of a user utilizing an alternate boot attachment mechanism and illustrating the fin assembly in its locked position for walking.

Referring to FIG. 10, the illustrated boot 12 in this instance is integral with a neoprene wader or the like so as to be much smaller than the boot 12 illustrated in the prior figures. In this instance, in order to firmly maintain the heel portion 32 of the boot 12 securely in the heel cup 76, the ankle strap 198 is positioned through the first set of connection openings 190, 192 of the strap 186 so as to secure the ankle closer to the heel cup 76. Likewise, a different connection configuration is illustrated in FIG. 10 for the first and second straps 174 and 182. In this instance, the strap 174 and the strap 182 are criss-crossed by connecting the strap 182 with slot 178 and slot 172, while connecting the first strap 174 with the slot 170 and slot 180. This enables the straps 174 and 182 to be criss-crossed over the top of the boot 12 as opposed to the prior embodiments. In either instance, the important element of the connection mechanism 24 is that the boot 12 of the user 14 be held firmly down against the base plate 68 of the base member 22 so that the boot 12 does not lift away from the plate 68 when the user 14 moves his leg 13 and boot 12 in direction 52 during the power stroke of the present invention. If the connection mechanism 24 is too loose or improperly connected, the boot 12 can lift away from the base member 22 and perhaps even slip from the heel cup 76.

As can be seen from the above, the present invention provides an improved fin assembly for enabling the user of a float tube to propel himself or herself in a forwardly direction. The present invention is of simple construction which permits reduced cost of this instance, in order to firmly maintain the heel portion 32 of the boot 12 securely in the heel cup 76, the ankle strap 198 is positioned through the first set of connection openings 190, 192 of the strap 186 so as to secure the ankle closer to the heel cup 76. Likewise, a different connection configuration is illustrated in FIG. 10 for the first and second straps 174 and 182. the user to latch the fin assembly in a closed position so as to prevent movement to its operational position thereby allowing the user to easily enter and exit a float tube as well as to walk on the ground surface or in shallow water without interference from the fin in an extended position. The arrangement of the present invention is lightweight and less cumbersome when maneuvering the fin assembly between its operational and reset positions, and the hinging arrangement of the present invention not only enables a more efficient use of the fin assembly but also provides extended lifetime due to the elimination of integral parts and the ready replacement of any parts that do wear out or break. Finally, the present invention is readily adaptable to all foot gear including "stocking feet" neoprene type waders.

The foregoing description and the illustrative embodiments of the present invention have been described in detail in varying modifications and alternate embodiments. It should be understood, however, that the foregoing description of the present invention is exemplary), only, and that the scope of the present invention is to be limited to the claims as interpreted in view of the prior art. Moreover, the invention illustratively disclosed herein suitably may be practiced in the absence of any element which is not specifically disclosed herein.

I claim:

1. A fin assembly for attachment to a boot of a float tube user, said boot having a sole, a toe, and a heel, said assembly comprising:

a base member including means for attachment to a boot, said base member having a front portion for attachment proximate the toe of said boot and a rear portion for attachment proximate the heel of said boot;

a fin member having front and rear ends;

hinge means for pivotally mounting the front end of said fin member to the front end portion of said base member, said fin member being pivotally movable between a first operational position wherein said fin member rear end projects below said base member to provide substantial resistance to flow of water as said fin member is moved in a rearward direction relative to said user for propelling said user forwardly in the water, and a second operational position wherein said fin member rear end is aligned proximate said base member rear portion to provide substantially reduced resistance to flow of water as said fin member is moved in a forward direction relative to said user, said hinge means including bias means for urging said fin member toward its first operational position wherein said fin member rear end projects below said base member; and means for limiting the maximum angle between said fin member in its first operational position and the plane of said base member.

2. The fin assembly as claimed in claim 1, wherein said angle limiting means comprises a stop member disposed at said fin member front end to limit the forward pivotal movement of said fin relative to said base member.

3. The fin assembly as claimed in claim 2, wherein said stop member comprises a shoulder arranged on said fin member from end and adapted to engage the bottom surface of said base member to prevent further rotation of said fin member relative to said base member.

4. The fin assembly as claimed in claim 1, wherein said maximum angle is less than approximately 90°.

5. The fin assembly as claimed in claim 4, wherein said maximum angle is approximately 60–75°.

6. The fin assembly as claimed in claim 1, wherein said assembly further includes means for releasably latching said fin member against said base member to selectively prevent movement of said fin member to its first operational position and to enable a float tube user to walk on a surface.

7. The fin assembly as claimed in claim 6, wherein said latching means comprises a latch arm pivotally secured to said base member rear portion and terminating at one end thereof in a pawl, and a catch member disposed at the rear end of said fin member and adapted for releasable engagement with said pawl.

8. The fin assembly as claimed in claim 7, wherein said latch arm is secured to said base member rear portion by a living hinge.

9. The fin assembly as claimed in claim 7, wherein said latching means further includes a spring member secured to said latch arm to urge said pawl toward a latched position with said catch member.

10. The fin assembly as claimed in claim 1, wherein said bias means comprises a spring member secured to said base member and biased against said fin member to urge said fin member toward its first operational position.

11. The fin assembly as claimed in claim 10, wherein said spring member includes means for selectively adjusting the bias force created thereby against said fin member.

12. The fin assembly as claimed in claim 1, wherein said fin assembly further includes means for assisting in transferring force from the leg of said float tube user to said fin member when moving said fin member in a rearward direction relative to said user to assist in propelling said user forwardly in the water.

13. The fin assembly as claimed in claim 12, wherein said force transferring means comprises a restraining strap secured between said base member and said fin member and sized to transfer force therebetween and to assist with said angle limiting means.

14. The fin assembly as claimed in claim 1, wherein said boot attachment means comprises adjustable swap members for securing a boot to said base member, and an adjustable heel position maintenance member for attachment to an ankle portion of a boot and adapted for holding the heel of a boot firmly against said base member rear portion.

15. A fin assembly for attachment to the boot of a float tube user and adapted for selective movement between an operating position for propelling the float tube user in a forwardly facing direction and a reset position to provide substantially reduced resistance to the flow of water as the fin assembly is moved in a forwardly direction relative to said user, said boot having a sole, a toe and a heel, said fin assembly comprising:

a base member having a from portion and a rear portion;

means for attaching said base member to a boot;

a fin member having from and rear end portions, said roar end portion having a width dimension greater than said from end portion;

hinge means for mounting the front end portion of said fin member to the front end portion of said base member to provide pivotal movement between said fin member operational position wherein said fin member rear end portion projects below said base member to provide substantial resistance by said fin member to flow of water as said fin assembly is moved in a rearward direction relative to said user, and said reset position wherein said fin member rear end portion is aligned proximate said base member rear portion, said hinge means including bias means for urging said fin member toward its operational position;

means for limiting the maximum angle of attack between said fin member in its operational position and the plane of said base member; and means for releasably maintaining said fin member against said base portion to selectively prevent said fin member from moving to its operational position and to enable a float tube user to walk on a surface.

16. The fin assembly as claimed in claim 15, wherein said bias means comprises a spring member interconnecting said base member and said fin member and including bias adjustment means.

17. The fin assembly as claimed in claim 15, wherein said fin member front end portion includes a pair of spaced ribs, and said mounting means comprises a hinging mechanism secured between said ribs and said base member.

18. The fin assembly as claimed in claim 17, wherein said fin assembly further includes spring means for urging rotation of said fin member about said hinge mechanism to its operational position.

19. The fin assembly as claimed in claim 15, wherein said fin member releasable maintenance means comprises a latch arm pivotally secured to said base member rear portion and including a pawl disposed at one end thereof, and a catch member disposed on said fin member rear end portion adapted for releasable engagement with said pawl.

20. The fin assembly as claimed in claim 19, wherein said fin member releasable maintenance means further includes a spring member secured to said base member rear portion for bias engagement against said latch arm to urge engagement of said pawl with said catch member.

21. The fin assembly as claimed in claim 15, wherein said fin assembly further includes means for assisting in transferring force from the leg of said float tube user to said fin member when moving said fin member in a rearward direction relative to said user to assist in propelling said user forwardly in the water.

22. A fin assembly for attachment to a boot having a sole, a toe, a heel and an ankle portion, said assembly comprising:

a fin member having a front portion, a rear portion, an upper surface and a bottom surface, said rear portion having a width dimension greater than said front portion;

hinge means for securing the front portion of said fin member proximate the toe of a boot to provide rotational movement of said fin member at its front portion between an operational position wherein said fin member rear portion projects below the sole of a boot to which said assembly is attached to form an acute angle between said fin member and the boot sole, and a reset position wherein said fin member upper surface is substantially aligned proximate the boot sole, said hinge means further including bias means for urging said fin member toward its operational position; and means for limiting the maximum angle between said fin member in its operational position and the plane of the sole of a boot to which said assembly is attached.

23. The fin assembly as claimed in claim 22, wherein said fin assembly further includes means for releasably maintaining said fin member in its reset position to selectively prevent said fin member from moving to its operational position to permit walking on said fin member bottom surface.

24. The fin assembly as claimed in claim 22, wherein the bias force exerted by said bias means is selectively adjustable.

25. The fin assembly as claimed in claim 22, wherein said hinge means comprises a base member having front and rear portions releasably attachable to the sole of a boot, and a hinge member for attaching said fin member front portion to said base member front portion for limited pivotal movement of said fin member between said reset and said operational positions.

26. The fin assembly as claimed in claim 25, wherein said angle limiting means comprises a stop member adapted to limit said acute angle to approximately 60–75°.

27. The fin assembly as claimed in claim 26, wherein a restraining strap is secured between said base member and said fin member upper surface for assisting in transferring force from said base member to said fin member as well as for assisting said angle limiting means.

28. A fin assembly for attachment to a boot of a float tube user, said boot having a sole, a toe, and a heel, said assembly comprising:

a base member including means for attachment to a boot, said base member having a front portion for attachment proximate the toe of said boot and a rear portion for attachment proximate the heel of said boot;

a fin member having front and rear ends;

means for pivotally mounting the front end of said fin member to the front portion of said base member, said fin member being pivotally movable between a first operational position wherein said fin member rear end projects below said base member to provide substantial resistance to flow of water as said fin member is moved in a rearward direction relative to said user for propelling said user forwardly in the water, and a second operational position wherein said fin member rear end is aligned proximate said base member rear portion to provide substantially reduced resistance to flow of water as said fin member is moved in a forward direction relative to said user;

means for limiting the maximum angle between said fin member in its first operational position and the plane of said base member; and latch means including a latch arm pivotally secured to said base member rear portion and terminating at one end thereof in a pawl, and a catch member disposed at the rear end of said fin member adapted for releasable engagement with said pawl for releasable latching of said fin member against said base member to selectively prevent movement of said fin member to its first operational position and to enable a float tube user to walk on a surface.

29. A fin assembly for attachment to the boot of a float tube user and adapted for selective movement between an operating position for propelling the float tube user in a forwardly facing direction and a reset position to provide substantially reduced resistance to the flow of water as the fin assembly is moved in a forwardly direction relative to said user, said boot having a sole, a toe and a heel, said fin assembly comprising:

a base member having a front portion and a rear portion;

means for attaching said base member to a boot;

a fin member having front and rear end portions, said rear end portion having a width dimension greater than said front end portion;

means for mounting the front end portion of said fin member to the front portion of said base member to provide pivotal movement between said fin member operational position wherein said fin member rear end portion projects below said base member to provide substantial resistance by said fin member to flow of water as said fin assembly is moved in a rearward direction relative to said user, and said reset position wherein said fin member rear end portion is aligned proximate said base member rear portion;

means for limiting the maximum angle of attack between said fin member in its operational position and the plane of said base member; and means for releasably maintaining said fin member against said base portion to selectively prevent said fin member from moving to its operational position and to enable a float tube user to walk on a surface and including a latch arm pivotally secured to said base member rear portion having a pawl disposed at one end thereof, and a catch member disposed on said fin member rear end portion adapted for releasable engagement with said pawl.

* * * * *

UNITED STATES PATENT AND TRADEMARK OFFICE

CERTIFICATE OF CORRECTION

PATENT NO. : 5,593,333
DATED : Jan. 14, 1997
INVENTOR(S) : Carroll L. Johnson

It is certified that error appears in the above-identified patent and that said Letters Patent is hereby corrected as shown below:

Col.1-14 should be deleted and substituted with col. 1-14 as per attached.

Signed and Sealed this

Twenty-second Day of July, 1997

Bruce Lehman

*Attest:*

BRUCE LEHMAN

*Attesting Officer*

*Commissioner of Patents and Trademarks*

FIN ASSEMBLY FOR FLOAT TUBE USERS

RELATED APPLICATIONS

This application is related to U.S. patent application Ser. No. 08/200,751 which was filed on Feb. 23, 1994, and now U.S. Pat. No. 5,531,621 and U.S. patent application Ser. No. 08/553,770, which was filed on Oct. 23, 1995, both of which applications are now pending. The contents of these two patent applications are specifically incorporated herein by reference.

BACKGROUND OF THE INVENTION

1. Field of the Invention

This invention relates generally to an improved propulsion mechanism for use with float tubes commonly used in fishing and, more particularly, to an improved foot fin assembly for propelling the user of such a float tube. Specifically, the present invention relates to an improved foot fin assembly for use in propelling the user of a float tube in a forwardly facing direction while simultaneously permitting the user of such foot fins to walk in shallow water without removing the fin assembly.

2. Description of the Prior Art

In general, users of float tubes for fishing incorporate some type of propulsion devices on their feet in order to assist in moving about the water's surface. Most float tube fins are similar in design to the foot fins used by swimmers and divers. Illustrations of such devices include those shown in U.S. Pat. Nos. 1,745,280, 2,898,611, 3,183,529, 3,268,927, 4,857,024, 4,889,510, 4,929,206, 4,940,437 and 5,108,327 as well as German Patent No. 4020235. Such devices operate by movement of the user's legs and feet in a flutter kick which propels the swimmer or diver in a forward direction. However, when they are utilized by the user of a float tube, they propel the float tube user rearwardly or backwardly relative to the direction the user is facing. This direction is generally opposite the direction the float tube user normally wishes to move when pursuing rising fish or in moving to another spot located in front of him. Moreover, the efficiency of such prior art fins is low so that the use of such devices in traveling any type of a distance when using a float tube is generally very strenuous and tiring.

In addition, these types of fins generally limit normal walking foot movement due to their forward extension portions which create a risk of falling while walking with the fins on. Walking in marginal water to enter or exit a body of water is particularly hazardous, for in addition to the clumsiness of the protruding fins and the restriction of movement and visibility caused by the float tubes, the walker has to overcome the water's resistance on the fins with each step. As a consequence, most users of forward extending fins walk backwards to enter and exit the water, and such backward walking with a bulky float tube in place creates a significant danger of falling and injury to the user.

The process of donning and removing a ring-shaped float tube while wearing such forwardly extending prior art fins is also difficult and hazardous. For example, the bulk and shape of an annular float tube limits movement, necessitating that the fins be attached to the user's feet prior to donning the float tube. In such an instance, with the float tube lying flat on the ground and the fins attached to the user's feet, the user then balances on one foot while stepping over the circumference of the tube with the other foot and inserting the other foot with fin into the leg opening of a float tube seat. Thus straddling the tube, the user then shifts his or her balance to the foot now inside the tube so as to lift the opposite foot with fin over the tube and insert it also into the leg opening of the seat. At this particular point, balancing is especially difficult presenting a danger of falling. The forward extension of such prior art fins, their general configuration and size, and the constriction of the seat of an annular float tube makes it extremely awkward to insert both feet with fins in place into the leg opening of a float tube. Balancing is especially difficult while bending over to maneuver the unwieldy tube into position to facilitate inserting the fin of the second foot into the leg opening.

As the result of such difficulties, several fins have been designed to provide means of forward propulsion by float tube users. Moreover, designs have been provided wherein a single paddle is secured to an existing shoe of a float tube user. Such designs include U.S. Pat. Nos. 1,983,609, 2,395,844 and 4,664,639. Moreover, an unpatented device known as the Paddle Pusher by Fishmaster Manufacturing Co. of Oklahoma City, Okla., provides side paddles to be worn on existing tennis shoes. The design of these type of fins compel the float tube user to assume a forced, unnatural position in the float tube during use. Moreover, these designs are generally inefficient in use relative to a full leg movement of the user of a float tube. For example, the design and construction of a float tube seat typically places a user thereof in the posture of a person seated in a chair with his or her legs and feet extended generally outwardly and forwardly. Use of the fin disclosed in U.S. Pat. No. 4,664,639 requires the user to lean forward against the designed posture of the float tube in order to position his or her legs in a vertical plane to provide sufficient leverage to make use of the device of this particular patent. This is due to the fact that the fin is integrally secured as part of the sole of the shoe or as part of a sleeve that fits over the shoe. In either instance, substantial rearward force from the leg and foot of the float tube user is necessary to move the fin away from the sole of the shoe and into position to create forward user motion. Moreover, this integral flap is by its nature urged toward its closed position against the boot sole. The paddle pusher device also compels the user of a float tube to assume a forced, upright position to move through the water. As a consequence, much of the user's leg motion with these devices is wasted and such awkward movement within the float tube is inherently dangerous.

U.S. Pat. Nos. 805,525 and 3,081,467 both disclose devices for attachment to the leg of a user to assist in swimming, which devices include plural flaps to assist in propulsion by providing resistance against water movement in one direction. The device illustrated in U.S. Pat. No. 805,525 requires specific movement of the user to open and close the flaps. The device illustrated in U.S. Pat. No. 3,081,467 is adapted to be oriented in a vertically downward position from the toe of a swim flipper for operation and in a vertically upward position in order to permit walking by a swimmer. However, given the nature of a swim flipper, forward walking is very difficult as previously mentioned. Moreover, this device is designed to slip over the foot similar to a swim flipper and designed to help push water away from the foot as the user's leg is extended outwardly thereby pushing the user of a float tube rearwardly as with many prior art devices.

The devices of the above related applications Ser. No. 08/200,751, filed Feb. 23, 1994, now U.S. Pat. No. 5,531,621 and Ser. No. 08/553,770 filed Oct. 23, 1995, the contents of which have been specifically incorporated herein by reference, overcome many of the objections to the prior art devices described above. However, the hinging arrangement of these related inventions can sometimes be a little awkward when moving any one of them from its closed to its operative position. The present invention, however, overcomes all of the aforementioned difficulties of the prior art devices and also improves the ease by which a user of the device can move the device in its reset position for minimum water resistance to its operative position for paddling or to a fixed position for walking in shallow water.

SUMMARY OF THE INVENTION

Accordingly, it is one object of the present invention to provide an improved float tube fin assembly for enabling forward propulsion in the direction which the user faces.

It is another object of the present invention to provide a fin assembly which is designed to permit the user to walk in shallow water without removal of the fin assembly from the feet of the user.

Yet another object of the present invention is to provide a fin assembly for use by a user of a float tube which is more efficient and utilizes less energy for movement due to reduced drag on the reset stroke.

A further object of the present invention is to provide a fin assembly for attachment to the boot of a float tuber user which is designed for greater ease of operation and movement between its operational position and its reset position.

Still another object of the present invention is to provide a fin assembly which is of simpler construction and greater adaptability for fastening to a wide variety of foot gear.

To achieve the foregoing and other objects and in accordance with the purpose of the present invention, as embodied and broadly described herein, a fin assembly is disclosed for attachment to a boot of a float tube user, the boot having a sole, a toe and a heel. The assembly includes a base member having a mechanism for attachment to a boot. The base member has a front portion for attachment proximate the toe of the boot and a rear portion for attachment proximate the heel of the boot. A fin member is provided with front and rear ends. A mechanism is provided for pivotally mounting the front end of the fin member to the front portion of the base member. The fin member is pivotally moveable between a first operational position wherein the fin member rear end projects below the base member to provide substantial resistance to flow of water as the fin member is moved in a rearward direction relative to the user for propelling the user forwardly in the water, and a second operational position wherein the fin member rear end is aligned proximate the base member rear portion to provide substantially reduced resistance to flow of water as the fin member is moved in a forward direction relative to the user. Finally, a mechanism is provided for limiting the maximum angle between the fin member in its first operational position and the plane of the base member.

BRIEF DESCRIPTION OF THE DRAWINGS

Figure 6:
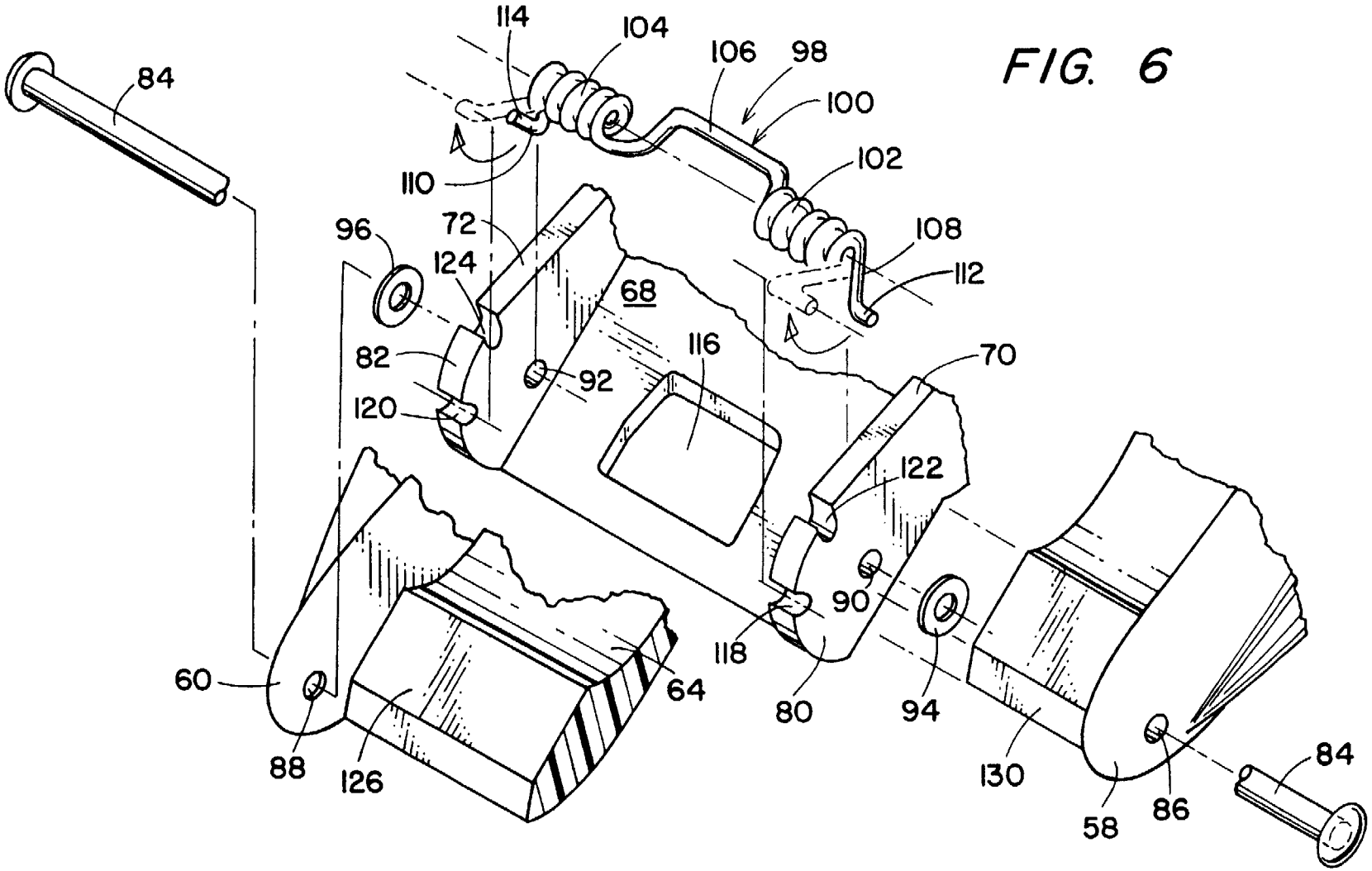
FIG. 6 is an enlarged exploded view, with some parts in section, of the hinge mechanism of the present invention.
Figure 7:
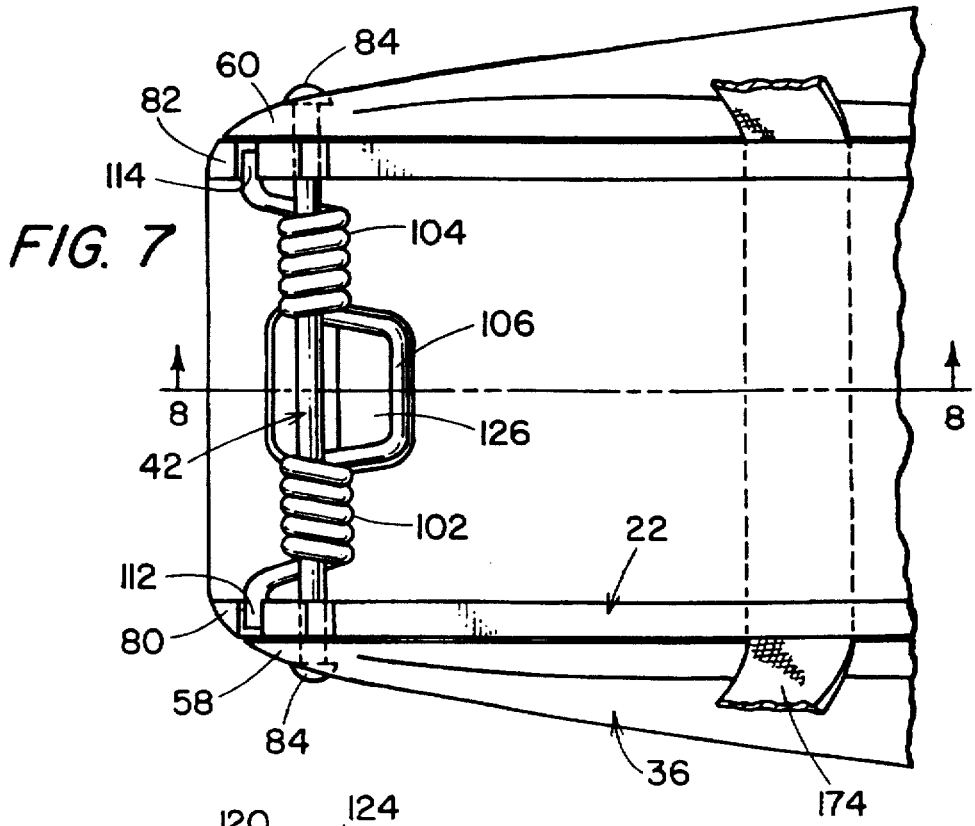
FIG. 7 is a top plan view of the forward portion of the fin assembly constructed in accordance with the present invention with the fin member in its reset position.
Figure 9:
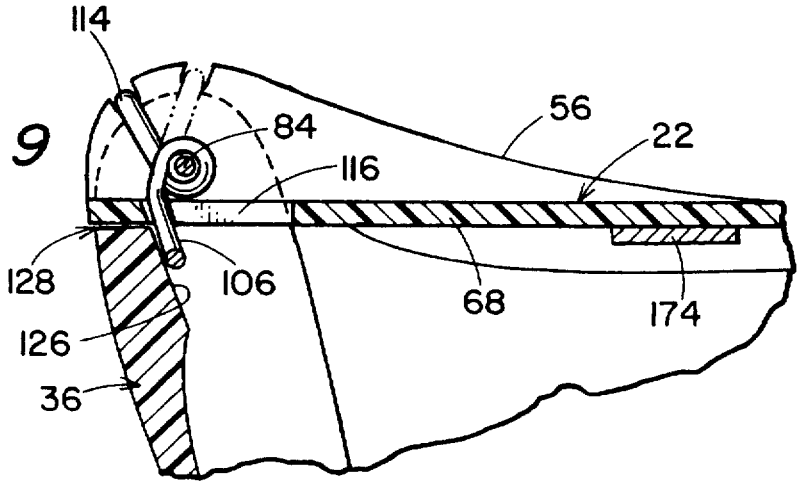
FIG. 9 is a cross-sectional view similar to that of FIG. 8 but illustrating the fin assembly in its open operational position of maximum operational angle.
Figure 11:
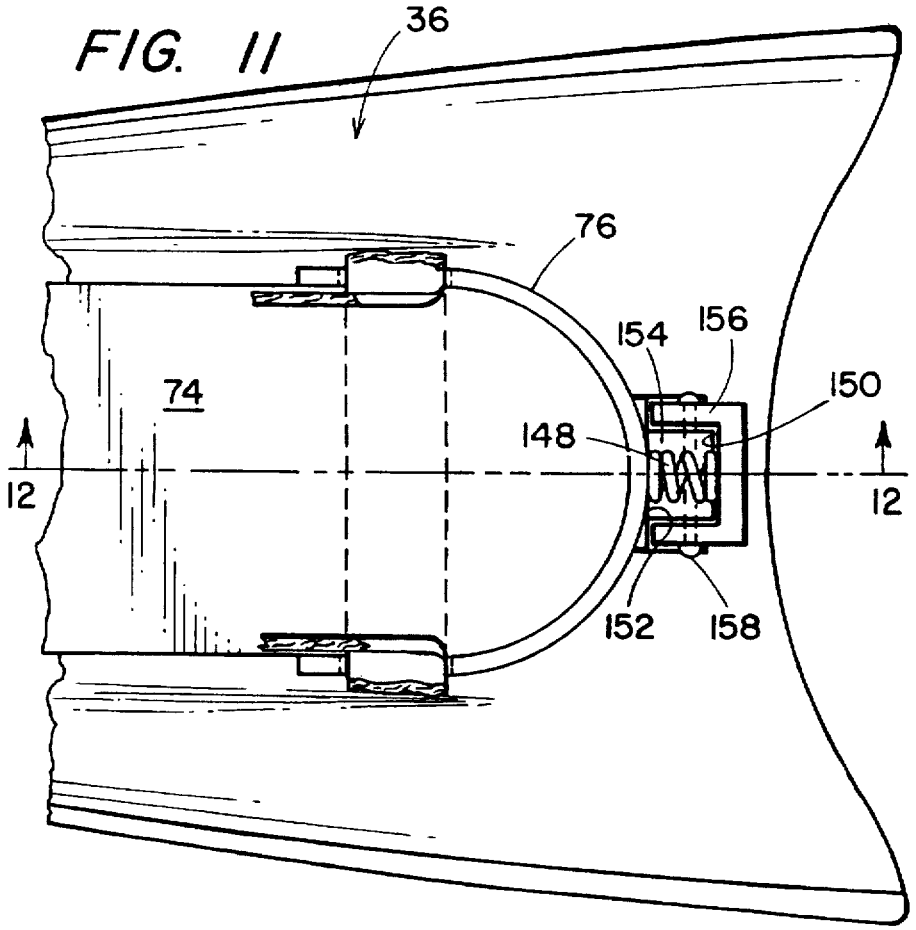
FIG. 11 is a top plan view of the rear portion of the fin assembly in accordance with the present invention with the fin member in its latched position.
Figure 12:
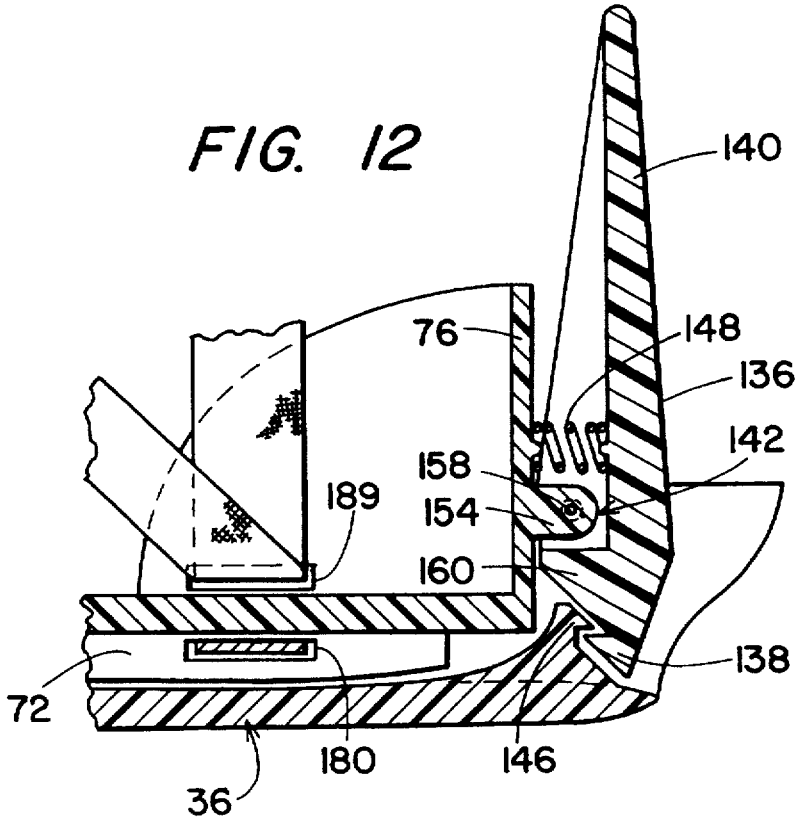
FIG. 12 is a sectional view taken substantially along line 12—12 of FIG. 11 and illustrating the fin assembly of the present invention in its latched walking position.
Figure 13:
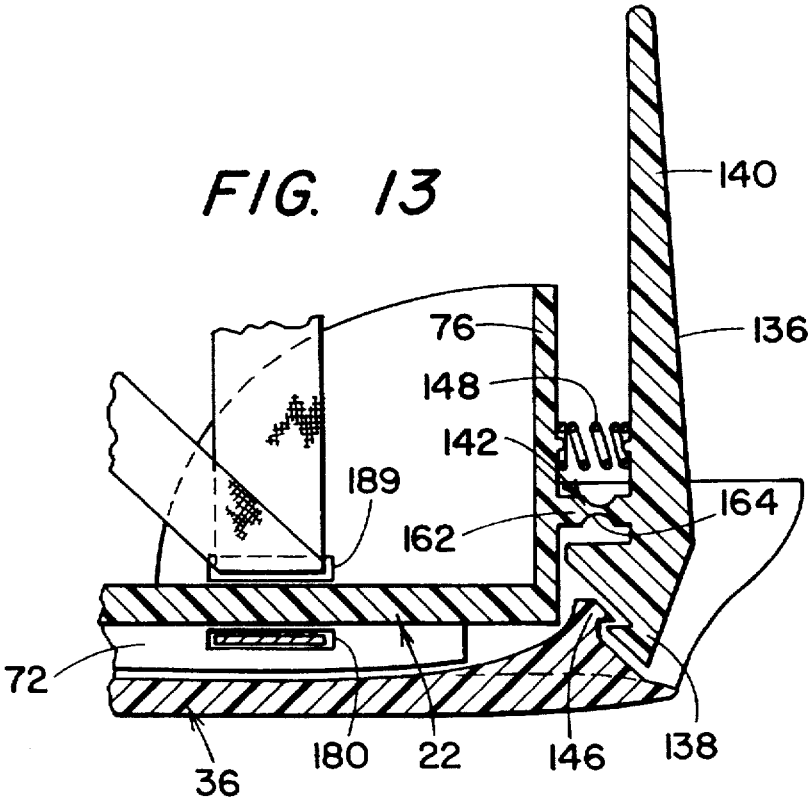
FIG. 13 is a sectional view similar to that of FIG. 12 but illustrating an alternate hinge arrangement for the latching mechanism of the present invention.

The accompanying drawings which are incorporated in and form a part of the specification illustrate preferred embodiments of the present invention and, together with a description, serve to explain the principles of the invention. In the drawings:

FIG. 1 is a side perspective view illustrating a fin assembly constructed in accordance with the present invention in position on the foot of a user while in a float tube and in an operational position;

FIG. 2 is a side view of the fin assembly of the present invention secured to the boot of a user and in an open operational position;

FIG. 3 is a side view of the fin assembly of the present invention mounted to the boot of a user and illustrating the fin assembly in its second operational or reset position;

FIG. 4 is a side perspective view of the fin assembly of the present invention attached to the boot of a user and illustrating the fin assembly in its open operational position;

FIG. 5 is a rear perspective view of the fin assembly of the present invention in its open operational position;

FIG. 6 is an enlarged exploded view, with some parts in section, of the hinge mechanism of the present invention;

FIG. 7 is a top plan view of the forward portion of the fin assembly constructed in accordance with the present invention with the fin member in its reset position;

FIG. 8 is a cross-sectional view taken substantially along line 8—8 of FIG. 7;

FIG. 9 is a cross-sectional view similar to that of FIG. 8 but illustrating the fin assembly in its open operational position of maximum operational angle;

FIG. 10 is a side perspective view of the fin assembly of the present invention secured to the foot of a user utilizing an alternate boot attachment mechanism and illustrating the fin assembly in its locked position for walking;

FIG. 11 is a top plan view of the rear portion of the fin assembly in accordance with the present invention with the fin member in its latched position;

FIG. 12 is a sectional view taken substantially along line 12—12 of FIG. 11 and illustrating the fin assembly of the present invention in its latched walking position; and FIG. 13 is a sectional view similar to that of FIG. 12 but illustrating an alternate hinge arrangement for the latching mechanism of the present invention.

DETAILED DESCRIPTION OF THE PREFERRED EMBODIMENTS

Referring first to FIGS. 1 and 2, a fin assembly 10 is illustrated in its extended operational position. The fin assembly 10 is secured to a boot 12 of a user 14 positioned within a typical float robe 16. The fin assembly 10 is designed to propel the user 14 and the float tube 16 forwardly across a water surface 18 in the direction illustrated by the arrow 20 by movement of the legs 13 of the user 14. In this manner, the user 14 is moved in the direction which he faces thus enhancing safety as well as providing a significant advantage to the user 14 when fishing or the like.

The principal components of the fin assembly 10 of the present invention are constructed primarily of molded semi-rigid plastic material, although other strong, lightweight and corrosion resistant materials such as aluminum can be utilized integral with plastic materials, or as a substitute for the plastic material in some parts of the fin assembly 10. In addition, it should be understood that in the drawings, only one fin assembly or a sub-assembly of one fin assembly is described in detail, and it should be understood that there are paired left and right fins and subassemblies which are constructed and operate in substantially, identical fashion.

The fin assembly 10 of the present invention includes a base member 22 which is secured to the boot 12 of a user 14 by an attachment mechanism 24. The base member 22 includes a front portion 26 and a rear portion 28 which are secured, respectively, to the toe 30 and heel 32 of the boot 12. The boot 12 also includes an ankle portion 34 which is secured by the attachment mechanism 24 as described in greater detail below. The fin assembly 10 also includes a fin member 36 having a front portion 38 and a rear portion 40. The front portion 38 of the fin member 36 is secured to the front portion 26 of the base member 22 by a hinge mechanism 42 as described in greater detail below.

Referring now to in more detail to FIGS. 1–5, the fin member 36 includes a pair of side edges 44, 46 which diverge outwardly from each other from the front portion 38 toward the rear portion 40. In this manner, the width dimension of the rear portion 40 is substantially greater than the width dimension of the front portion 38. This shape is typical of swim fins or flippers. The outer surface 50 of the fin member 36 is preferably slightly curved upwardly toward the base member 22 in a scooped fashion so as to create greater water resistance when the fin assembly 10 is moved in a rearwardly direction, the power stroke, as indicated by the arrow 52. A pair of ridge supports 54, 56 extended rearwardly from the front portion 38 toward the rear portion 40 to provide strength and rigidity to the fin member 36. The ridge supports 54, 56 terminate at the forward portion 38 of the fin member 36 in rounded ends 58, 60. The rounded end portions 58, 60 of the ridges 54, 56 serve as pivot members for the hinge mechanism 42 as described in greater detail below. A restraining strap 62 preferably is secured to the inner surface 64 of the fin member 36 and the bottom surface 66 of the base member 22. The restraining strap 62 is preferably woven nylon, although any suitably strong yet flexible material may be utilized. The restraining strap 62 may be secured to the surfaces 64, 66 by riveting, sewing or any other suitable manner of attachment. The restraining strap 62 functions to assist in transferring the force generated in the power stroke from the foot 12 and leg 13 of user 14 to the fin member 36. It also assists the stop members (discussed in detail below) in limiting the angle "X" between the plane of the base member 22 and the fin member 36 when the fin assembly 10 is in its full operational position as illustrated in FIG. 2.

The base member 22 preferably includes a base plate 68 that is sized for receiving the shoe or boot 12 of the user 14. The plate 68 is reinforced by a pair of side edges 70, 72 which, in preferred form, depend downwardly from the bottom surface 66 as well as extend upwardly above the upper surface 74 of the base plate 68. In preferred form, the side edges 70, 72 terminate at the rear portion 28 of the base member 22 in a heel cup 76 that is sized and shaped to snugly receive the heel portion 32 of the boot 12. In this manner, the shoe or boot 12 may be snugly held against the base member 22 by the attachment mechanism 24 as further described in greater detail below.

When the fin assembly 10 is in its fully first operational position as illustrated in FIGS. 1, 2 and 4, the fin member 36 pivots relative to the base member 22 at the hinge mechanism 42 and extends below the base member 22 at an angle "X". In preferred form, the angle "X" is less than 90° and is preferably an acute angle ranging between 60°–75°. The actual preferred angle "X" within this range may vary depending upon the flexibility of the material selected for construction of the fin member 36. If the angle is substantially less than about 60°, then the power efficiency of the fin assembly 10 is substantially reduced. However, if the angle substantially exceeds 75°, then the fin assembly 10 tends to lift the front of the tube 16 rather than propel it forwardly.

As the user 14 moves his or her leg 13 from position A to position B to position C as illustrated in Fig. 1, thereby moving the fin member 36 and fin assembly 10 in the direction indicated by the arrow 52 of FIG. 4, the inner surface 64 of the fin member 36 creates substantial resistance to the flow of water and thus propels the user 14 forwardly in the direction 20 of FIG. 1. Once this power or operational stroke of the user 14 is completed, the user 14 then moves his or her leg 13 from position C back to position A. When this movement occurs, water pressure against the outer surface 50 of the fin member 36 feathers the fin member 36 and moves it to its reset position as indicated in FIG. 3. Thus, as the fin member 36 and fin assembly 10 is moved back toward its starting position A in the direction indicated by the arrow 78 of FIG. 3, the feathered or reset position of the fin member 36 offers substantially reduced water resistance or drag to movement of the fin assembly 10 in this direction 78. Consequently, the user 14 alternates movement of his or her legs 13 back and forth between positions A and C, moving himself or herself forwardly in the direction 20 when moving the fin assembly 10 in the direction 52 and resting leg muscles when moving the legs 13 back from position C to A in direction 78. Due to the construction of the present invention and the hinging mechanism as described below along with the angle limitations imposed on angle "X", the user 14 may move his or her legs 13 between positions A and C to propel himself or herself forward without having to lean forward in the float tube 16 or in any other way having to adjust his or her posture other than sitting back in a fashion typical of sitting in a chair. This provides maximum balance and safety with a minimum of effort of the user 14.

Referring now with particularity to FIGS. 5–9, the side edges 70 and 72 of the base member 22 each terminate at their front portion in curved end portions 80 and 82, respectively. The hinge mechanism 42 which interconnects the fin member 36 with the base member 22 preferably includes a hinge pin 84 which passes through apertures 86, 88 in the ends 58, 60 of the ridge supports 54, 56 and apertures 90, 92 which extend through the end portions 80, 82 of the side edges 70, 72. Preferably, a washer 94 is positioned between the end 58 and the end portion 80, while a washer 96 is positioned between the rounded end 60 and the end portion 82. The hinge pin 84 may be in the form of a bolt, rivet, or any other known pin member and firmly secures the rounded ends 58, 60 to the end portions 80, 82.

In the preferred embodiment of the present invention, a spring mechanism 98 is provided to create a bias force against the fin member 36 to urge it to its fully operational position as illustrated in FIGS. 1, 2 and 4. The purpose of this bias force is so that the fin member 36 might be moved to its fully operational position as soon as a user 14 has completed the reset stroke and moved the boot 12 and leg 13 into the position A. Otherwise, a portion of the power stroke wherein the user 14 moves the leg 13 from position A toward position C would be required to push the fin member 36 outwardly from the base member 22 until its full operational position has been established. Such a procedure wastes a portion of the power stroke and energy of the user 14. The spring mechanism 98 obviates this loss of a portion of the power stroke by urging the fin member 36 to its fully extended and operational position once the user 14 has ceased forward movement of his or her leg 13 during the reset stroke.

In preferred form, the spring mechanism 98 may be of any selected type of spring bias device but preferably includes a unitary spring member 100 having a pair of helical spiral portions 102 and 104 that are spaced by a straight portion forming a bight 106. Each helical spiral portion 102, 104 terminates in an L-shaped extension 108, 110, respectively, which respectively include end members 112, 114. The forwardmost portion 26 of the base member 22 includes an aperture 116 in the base plate 68. The aperture 116 is centered between the end portions 80, 82 beneath the hinge pin 84. The spring member 100 is sized and shaped so that the hinge pin 84 passes through the helical spiral portions 102, 104, and that the bight 106 is spaced immediately above the aperture 116 and is sized to pass therethrough. The end portions 80, 82 each include a first pair of notches 118, 120, respectively, and a second pair of notches 122, 124, respectively. The notches 118, 120 and 122, 124 are sized and shaped to receive the end members 112, 114 of the L-shaped extensions 108, 110 of the spring member 100. Once the end portions 112, 114 are positioned within the notches 118, 120, respectively, the bight member 106 presses down against the upper surface 64 of the fin member 36 through the aperture 116. In preferred form, a raised surface 126 is created on the upper surface 64 at the forward portion 38 of the fin member 36. Thus, the spring tension created by the helical spiral portions 102, 104 creates a bias force against the surface 126 by the bight member 106 when the end portions 112, 114 are engaged within the notches 118, 120. If it is desired to increase the bias force of the spring member 100 against the fin member 36, then the end portions 112, 114 may be moved to the paired notches 122, 124, respectively. This creates a greater tension in the spiral portions 102, 104 creating a greater bias force of the bight 106 against the surface 126. This bias force tends to urge the fin member 36 away from the base member 22 when there is no water pressure against the outer surface 50 of the fin member 36. Therefore, once the user 14 has moved the fin assembly 10 into its position A at the beginning of its power stroke, the spring member 100 will force the fin member 36 away from the base member 22 to the full extent allowed by the fin assembly 10.

A stop mechanism 128 is preferably utilized to limit the angle "X" integrated between the fin member 36 and the base member 22 when the fin member 36 is in its fully operational position created by the bias force of the spring member 100. In preferred form, the stop member 128 includes a shoulder 130 that is positioned at the forwardmost end of the fin member 36 and a stop ledge 132 that is positioned along the forward bottom surface of the base portion 22. The placement of the shoulder 130 in terms of how far forwardly it extends at the front of the fin member 36 as well as the angle of the surface 130 relative to the stop surface 132 will determine the maximum angle "X". Clearly, the closer the surfaces 130, 132 when the fin member 36 is in its fully retracted position as illustrated in FIG. 8, the smaller the angle "X". Moreover, the greater the surfaces 130, 132 are spaced from each other in the reset position, the greater the angle "X". It should also be noted that the stop mechanism 128 and the retaining strap 62 are the two members that transfer the force from the leg 13 of the user 14 to the fin member 36 through the base member 22. In preferred form, the length of. the restraining strap 62 is designed to be at its fully extended, taut position when the shoulder 130 and the stop surface 132 are in an abutting relationship, thereby enabling the retention strap 62 to assist in transferring force. Should the length of the strap 62 be too great, it will remain slack when the stop mechanism 128 is fully engaged, thereby preventing it from functioning in transferring force. Moreover, if the length of the retention strap 62 is too short, it will be completely taut before the stop mechanism 128 is fully engaged thereby transferring all of the force through the retention strap 62 and none of it through the stop mechanism 128. Consequently, the length and positioning of the strap 62 relative to the stop mechanism 128 is important.

Referring now with particularity to FIG. 5 and 10–13, the fin member 36 may be selectively secured to the base member 22 wherein the fin member 36 is not free to move to its open operational position. This latching of the fin member 36 to the base member 22 enables the user 14 to readily put the fin assembly 10 onto the boot 12 and allows the user 14 to enter the float tube 16 without the fin member 36 flopping around in its open position. Moreover, this latching of the fin member 36 to the base member 22 also permits the user 14 to walk on the bottom surface 50 of the fin member 36 on dry land or in shallow water. To accomplish this latching, a latch mechanism 134 is preferably utilized. In preferred form, the latching mechanism 134 includes a latch arm 136 having a pawl 138 at its connection end and a lever arm 140 at its free end. The latch arm 136 is hinged at its center portion 142 to allow the lever arm 140 to engage or disengage the pawl 138. In preferred form, a catch member 144 is disposed on the inner surface 64 toward the rear portion 40 of the fin member 36 and includes a tooth or hook end 146 that is sized and shaped for engagement with the pawl 138. A spiral spring 148 is positioned between the inner surface 150 of the lever arm 140 and the outer surface 152 of the heel cup 76. The spring member 148 is positioned so as to create an outward bias force against the lever arm 140 above the hinge member 142 so as to continuously urge the pawl 138 into engagement with the catch hook 146. By pressing the lever arm 140 toward the ankle 34 of the user 14, the bias of the spring member 148 is overcome, and the pawl 138 disengages from the hook 146. Once the pressure against the lever arm 140 is released, the spring member 148 immediately urges the lever ann 140 outwardly from the heel cup 76 which pivots the pawl 138 toward the base member 22.

In one form of the invention as more clearly illustrated in FIG. 12, the heel cup 76 includes a hinge bracket 154 which interconnects with a pair of hinge arms 156 utilizing a hinge pin 158. As can be seen from FIG. 12, the spring member 148 is disposed upwardly of the hinge mechanism 142 so as to create a bias force against the pawl 138 toward the heel cup 76 until the stop 160 engages the heel cup 76 or the pawl 138 engages the hook 146. Once a force is created against the lever arm 140 which overcomes the bias force of the spring 148 in a direction toward the heel cup 76, the pawl 138 will be rotated away from the heel cup 76 so as to disengage from the catch hook 146 thereby allowing the fin member 36 to immediately move toward its operational position due to the bias of the spring member 100. In an alternate form of the invention illustrated in FIG. 13, the hinge mechanism 142 is in the form of a living hinge wherein the latch arm 136 is connected directly to the heel cup 76 by an integral connecting arm 162 having a reduced center portion 164 that acts as the hinge portion. Thus, as pressure against the lever ann 140 overcomes the bias of the spring 148, the pawl 138 is moved away from the heel cup 76 by flexing the connecting arm 162 thereby releasing the fin member 36. Likewise, the bias of the spring member 148 against the lever arm 140 pivots the latch arm 136 about the connecting arm 162 to engage the pawl 138 with the catch hook 146 similar to the prior embodiment.

As previously indicated, the base member 22 is secured to the boot 12 of the user 14 by an attachment mechanism 24. In one embodiment of the present invention as clearly illustrated in FIGS. 1–5, a pair of slots 170, 172 are disposed in the side edges 70, 72 toward the forward portion 26 of the base member 22. The slots 170, 172 are preferably aligned below the base plate 68. A first strap 174 passes through the slots 170, 172 and has its ends interconnected at a connecting member 176. The connecting member 176 may be in the form of a buckle as illustrated in FIGS. 2 and 4, or in the form of a plastic latching mechanism as indicated in FIGS. 3 and 5 and as commonly found in most sporting goods stores. In either event, the strap 174 is adjustable at the connecting member 176 so as to firmly hold the toe 30 against the base plate 68. In similar manner, a pair of slots 178, 180 are positioned in the side edges 70, 72 at the rear portion 28 of the base member 22 and aligned below the base plate 68. A second strap 182 passes through the slots 178, 180 beneath the bottom surface 66 of the base plate 68 and interconnects at its ends by a connecting member 184 similar to the connecting member 176. The connecting member 184 may likewise be a buckle or other latching mechanism as previously described. A third strap 186 is also provided and it passes through the slots 178, 180. Preferably, additional slots 188, 189 are spaced immediately above each of the slots 178, 180, respectively, in the heel cup 76 above the plate 68. The third strap 186 passes back through the slots 188, 189 so as to move upward along the boot 12 toward the ankle portion 34. The strap 186 preferably includes a first pair of connection openings 190, 192 and a second set of connection openings 194, 196 that are at the terminal ends thereof. An ankle strap 198 surrounds the ankle portion 34 of the boot 12 and passes through the first set of openings 190, 192 or the second set of openings 194, 196. The ends of the ankle strap are adjustably interconnected by a connection member 200 which is similar to the connection members 176 and 184. FIGS. 1–5 illustrate the strap 198 passing through the upper connection openings 194, 196 of the strap 186. However, the ankle strap 198 may also pass through the first set of connection openings 190, 192 as more clearly illustrated in FIG. 10. Whether the ankle strap 198 passes through the first set of connection openings 190, 192 or the second set of connection openings 194, 196 depends upon the size and type of boot 12 that is utilized by the user 14.

Referring to FIG. 10, the illustrated boot 12 in this instance is integral with a neoprene wader or the like so as to be much smaller than the boot 12 illustrated in the prior figures. In this instance, in order to firmly maintain the heel portion 32 of the boot 12 securely in the heel cup 76, the ankle strap 198 is positioned through the first set of connection openings 190, 192 of the strap 186 so as to secure the ankle closer to the heel cup 76. Likewise, a different connection configuration is illustrated in FIG. 10 for the first and second straps 174 and 182. In this instance, the strap 174 and the strap 182 are criss-crossed by connecting the strap 182 with slot 178 and slot 172, while connecting the first strap 174 with the slot 170 and slot 180. This enables the straps 174 and 182 to be criss-crossed over the top of the boot 12 as opposed to the prior embodiments. In either instance, the important element of the connection mechanism 24 is that the boot 12 of the user 14 be held firmly down against the base plate 68 of the base member 22 so that the boot 12 does not lift away from the plate 68 when the user 14 moves his leg 13 and boot 12 in direction 52 during the power stroke of the present invention. If the connection mechanism 24 is too loose or improperly connected, the boot 12 can lift away from the base member 22 and perhaps even slip from the heel cup 76.

As can be seen from the above, the present invention provides an improved fm assembly for enabling the user of a float tube to propel himself or herself in a forwardly direction. The present invention is of simple construction which permits reduced cost of manufacture and is substantially more efficient than many prior devices in that there is significantly less drag or water resistance on the reset stroke. Moreover, the present invention provides for automatic resetting of the operational position once the user completes the reset stroke and is ready to commence a power stroke. Furthermore, the present invention allows the user to latch the fin assembly in a closed position so as to prevent movement to its operational position thereby allowing the user to easily enter and exit a float tube as well as to walk on the ground surface or in shallow water without interference from the fin in an extended position. The arrangement of the present invention is lightweight and less cumbersome when maneuvering the fin assembly between its operational and reset positions, and the hinging arrangement of the present invention not only enables a more efficient use of the fin assembly but also provides extended lifetime due to the elimination of integral parts and the ready replacement of any parts that do wear out or break. Finally, the present invention is readily adaptable to all foot gear including "stocking feet" neoprene type waders.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A fin assembly for attachment to a boot of a float robe user, said boot having a sole, a toe, and a heel, said assembly comprising:

a base member including means for attachment to a boot, said base member having a front portion for attachment proximate the toe of said boot and a rear portion for attachment proximate the heel of said boot;

a fin member having front and rear ends;

hinge means for pivotally mounting the front end of said fin member to the front end portion of said base member, said fin member being pivotally movable between a first operational position wherein said fin member rear end projects below said base member to provide substantial resistance to flow of water as said fin member is moved in a rearward direction relative to said user for propelling said user forwardly in the water, and a second operational position wherein said fin member rear end is aligned proximate said base member rear portion to provide substantially reduced resistance to flow of water as said fin member is moved in a forward direction relative to said user, said hinge means including bias means for urging said fin member toward its first operational position wherein said fin member rear end projects below said base member; and means for limiting the maximum angle between said fin member in its first operational position and the plane of said base member.

2. The fin assembly as claimed in claim 1, wherein said angle limiting means comprises a stop member disposed at said fin member front end to limit the forward pivotal movement of said fin relative to said base member.

3. The fin assembly as claimed in claim 2, wherein said stop member comprises a shoulder arranged on said fin member front end and adapted to engage the bottom surface of said base member to prevent further rotation of said fin member relative to said base member.

4. The fin assembly as claimed in claim 1, wherein said maximum angle is less than approximately 90°.

5. The fin assembly as claimed in claim 4, wherein said maximum angle is approximately 60°–75°.

6. The fin assembly as claimed in claim 1, wherein said assembly further includes means for releasably latching said fin member against said base member to selectively prevent movement of said fin member to its first operational position and to enable a float tube user to walk on a surface.

7. The fin assembly as claimed in claim 6, wherein said latching means comprises a latch arm pivotally secured to said base member rear portion and terminating at one end thereof in a pawl, and a catch member disposed at the rear end of said fin member and adapted for releasable engagement with said pawl.

8. The fin assembly as claimed in claim 7, wherein said latch arm is secured to said base member rear portion by a living hinge.

9. The fin assembly as claimed in claim 7, wherein said latching means further includes a spring member secured to said latch arm to urge said pawl toward a latched position with said catch member.

10. The fin assembly as claimed in claim 1, wherein said bias means comprises a spring member secured to said base member and biased against said fin member to urge said fin member toward its first operational position.

11. The fin assembly as claimed in claim 10, wherein said spring member includes means for selectively adjusting the bias force created thereby against said fin member.

12. The fin assembly as claimed in claim 1, wherein said fin assembly further includes means for assisting in transferring force from the leg of said float tube user to said fin member when moving said fin member in a rearward direction relative to said user to assist in propelling said user forwardly in the water.

13. The fin assembly as claimed in claim 12, wherein said force transferring means comprises a restraining strap secured between said base member and said fin member and sized to transfer force therebetween and to assist with said angle limiting means.

14. The fin assembly as claimed in claim 1, wherein said boot attachment means comprises adjustable strap members for securing a boot to said base member, and an adjustable heel position maintenance member for attachment to an ankle portion of a boot and adapted for holding the heel of a boot firmly against said base member rear portion.

15. A fin assembly for attachment to the boot of a float tube user and adapted for selective movement between an opening position for propelling the float tube user in a forwardly facing direction and a reset position to provide substantially reduced resistance to the flow of water as the fin assembly is moved in a forwardly direction relative to said user, said boot having a sole, a toe and a heel, said fin assembly comprising:

a base member having a front portion and a rear portion;

means for attaching said base member to a boot;

a fin member having front and rear end portions, said rear end portion having a width dimension greater than said front end portion;

hinge means for mounting the front end portion of said fin member to the front end portion of said base member to provide pivotal movement between said fin member operational position wherein said fin member rear end portion projects below said base member to provide substantial resistance by said fin member to flow of water as said fin assembly is moved in a rearward direction relative to said user, and said reset position wherein said fin member rear end portion is aligned proximate said base member rear portion, said hinge means including bias means for urging said fin member toward its operational position;

means for limiting the maximum angle of attack between said fin member in its operational position and the plane of said base member; and means for releasably maintaining said fin member against said base portion to selectively prevent said fin member from moving to its operational position and to enable a float tube user to walk on a surface.

16. The fin assembly as claimed in claim 15, wherein said bias means comprises a spring member interconnecting said base member and said fin member and including bias adjustment means.

17. The fin assembly as claimed in claim 15, wherein said fin member front end portion includes a pair of spaced ribs, and said mounting means comprises a hinging mechanism secured between said ribs and said base member.

18. The fin assembly as claimed in claim 17, wherein said fin assembly further includes spring means for urging rotation of said fin member about said hinge mechanism to its operational position.

19. The fin assembly as claimed in claim 15, wherein said fin member releasable maintenance means comprises a latch arm pivotally secured to said base member rear portion and including a pawl disposed at one end thereof, and a catch member disposed on said fin member rear end portion adapted for releasable engagement with said pawl.

20. The fin assembly as claimed in claim 19, wherein said fin member releasable maintenance means further includes a spring member secured to said base member rear portion for bias engagement against said latch arm to urge engagement of said pawl with said catch member.

21. The fin assembly as claimed in claim 15, wherein said fin assembly further includes means for assisting in transferring force from the leg of said float tube user to said fin member when moving said fin member in a rearward direction relative to said user to assist in propelling said user forwardly in the water.

22. A fin assembly for attachment to a boot having a sole, a toe, a heel and an ankle portion, said assembly comprising:

a fin member having a front portion, a rear portion, an upper surface and a bottom surface, said rear portion having a width dimension greater than said front portion;

hinge means for securing the front portion of said fin member proximate the toe of a boot to provide rotational movement of said fin member at its front portion between an operational position wherein said fin member rear portion projects below the sole of a boot to which said assembly is attached to form an acute angle between said fin member and the boot sole, and a reset position wherein said fin member upper surface is substantially aligned proximate the boot sole, said hinge means further including bias means for urging said fin member toward its operational position; and means for limiting the maximum angle between said fin member in its operational position and the plane of the sole of a boot to which said assembly is attached.

23. The fin assembly as claimed in claim 22, wherein said fin assembly further includes means for releasably maintaining said fin member in its reset position to selectively prevent said fin member from moving to its operational position to permit walking on said fin member bottom surface.

24. The fin assembly as claimed in claim 22, wherein the bias force exerted by said bias means is selectively adjustable.

25. The fin assembly as claimed in claim 22, wherein said hinge means comprises a base member having front and rear portions releasably attachable to the sole of a boot, and a hinge member for attaching said fin member front portion to said base member front portion for limited pivotal movement of said fin member between said reset and said operational positions.

26. The fin assembly as claimed in claim 25, wherein said angle limiting means comprises a stop member adapted to limit said acute angle to approximately 60°–75°.

27. The fin assembly as claimed in claim 26, wherein a restraining strap is secured between said base member and said fin member upper surface for assisting in transferring force from said base member to said fin member as well as for assisting said angle limiting means.

28. A fin assembly for attachment to a boot of a float tube user, said boot having a sole, a toe, and a heel, said assembly comprising:

a base member including means for attachment to a boot, said base member having a front portion for attachment proximate the toe of said boot and a rear portion for attachment proximate the heel of said boot;

a fin member having front and rear ends;

means for pivotally mounting the front end of said fin member to the front portion of said base member, said fin member being pivotally movable between a first operational position wherein said fin member rear end projects below said base member to provide substantial resistance to flow of water as said fin member is moved in a rearward direction relative to said user for propelling said user forwardly in the water, and a second operational position wherein said fin member rear end is aligned proximate said base member rear portion to provide substantially reduced resistance to flow of water as said fin member is moved in a forward direction relative to said user;

means for limiting the maximum angle between said fin member in its first operational position and the plane of said base member; and latch means including a latch arm pivotally secured to said base member rear portion and terminating at one end thereof in a pawl, and a catch member disposed at the rear end of said fin member adapted for releasable engagement with said pawl for releasable latching of said fin member against said base member to selectively prevent movement of said fin member to its first operational position and to enable a float tube user to walk on a surface.

29. A fin assembly for attachment to the boot of a float tube user and adapted for selective movement between an operating position for propelling the float tube user in a forwardly facing direction and a reset position to provide substantially reduced resistance to the flow of water as the fin assembly is moved in a forwardly direction relative to said user, said boot having a sole, a toe and a heel, said fin assembly comprising:

a base member having a front portion and a rear portion;

means for attaching said base member to a boot;

a fin member having front and rear end portions, said rear end portion having a width dimension greater than said front end portion;

means for mounting the front end portion of said fin member to the front portion of said base member to provide pivotal movement between said fin member operational position wherein said fin member rear end portion projects below said base member to provide substantial resistance by said fin member to flow of water as said fin assembly is moved in a rearward direction relative to said user, and said reset position wherein said fin member rear end portion is aligned proximate said base member rear portion;

means for limiting the maximum angle of attack between said fin member in its operational position and the plane of said base member; and means for releasably maintaining said fin member against said base portion to selectively prevent said fin member from moving to its operational position and to enable a float tube user to walk on a surface and including a latch arm pivotally secured to said base member rear portion having a pawl disposed at one end thereof, and a catch member disposed on said fin member rear end portion adapted for releasable engagement with said pawl.

* * * * *